US011988202B2

(12) United States Patent
Ye

(10) Patent No.: US 11,988,202 B2
(45) Date of Patent: May 21, 2024

(54) BLOWING APPARATUS

(71) Applicant: LG Display Co., Ltd., Seoul (KR)

(72) Inventor: Jaehun Ye, Tokyo (JP)

(73) Assignee: LG DISPLAY CO., LTD., Seoul (KR)

( * ) Notice: Subject to any disclaimer, the term of this patent is extended or adjusted under 35 U.S.C. 154(b) by 9 days.

(21) Appl. No.: 18/070,260

(22) Filed: Nov. 28, 2022

(65) Prior Publication Data

US 2023/0204026 A1 Jun. 29, 2023

(30) Foreign Application Priority Data

Dec. 28, 2021 (JP) ..... 2021-214083

(51) Int. Cl.
*F04B 45/04* (2006.01)
*F04D 33/00* (2006.01)

(52) U.S. Cl.
CPC ..... *F04B 45/04* (2013.01); *F04D 33/00* (2013.01)

(58) Field of Classification Search
CPC ..... F04B 45/04; F04B 43/046; F04D 33/00; F04D 29/522; F04D 29/663; F04D 23/006; F04D 25/08; F04D 25/06; F04D 29/403; F04F 7/00; F05D 2210/12
See application file for complete search history.

(56) References Cited

U.S. PATENT DOCUMENTS

2004/0207292 A1* 10/2004 Scher ..... H10N 30/208 310/328
2011/0014069 A1* 1/2011 Wada ..... F04D 33/00 417/410.2
2014/0166260 A1* 6/2014 Roebke ..... F04D 27/00 165/244
2014/0175948 A1* 6/2014 Tanaka ..... F04D 33/00 310/330
2014/0341762 A1* 11/2014 Tanaka ..... F04B 43/046 417/410.2
2015/0023819 A1* 1/2015 Tanaka ..... F04D 33/00 417/410.2
2015/0173241 A1* 6/2015 Hsu ..... H05K 7/20209 165/104.34

(Continued)

FOREIGN PATENT DOCUMENTS

CN 212055309 U 12/2020
DE 27 01 595 A1 7/1978

(Continued)

OTHER PUBLICATIONS

Extended European search report issued in corresponding EP Patent Application No. 22209125.8 dated May 15, 2023.

*Primary Examiner* — Aaron R Eastman
(74) *Attorney, Agent, or Firm* — Morgan, Lewis & Bockius LLP

(57) ABSTRACT

A blowing apparatus includes a housing including an accommodating space and one or more blowing holes and a vibration apparatus in the accommodating space, wherein the vibration apparatus includes a first active vibration member, a second active vibration member connected to an inner lateral surface of the housing and connected to intersect with the first active vibration member, and a passive vibration member between the one or more blowing holes and the first active vibration member and connected to the first active vibration member.

27 Claims, 9 Drawing Sheets

(56) References Cited

U.S. PATENT DOCUMENTS

| | | | |
|---|---|---|---|
| 2016/0312802 | A1 | 10/2016 | Takeda |
| 2021/0176566 | A1 | 6/2021 | Ye |

FOREIGN PATENT DOCUMENTS

| | | | |
|---|---|---|---|
| EP | 2 743 512 | B1 | 2/2019 |
| JP | 2016-017428 | A | 2/2016 |
| JP | 2021-090141 | A | 6/2021 |
| KR | 2019-0041768 | A | 4/2019 |
| WO | WO2016-016963 | A1 | 4/2017 |

* cited by examiner

BLOWING APPARATUS

CROSS-REFERENCE TO RELATED APPLICATIONS

This application claims the benefit of and priority to Japanese Patent Application No. 2021-214083 filed on Dec. 28, 2021, the entirety of which is hereby incorporated by reference.

TECHNICAL FIELD

The present disclosure relates to an apparatus, and more particularly, to a blowing apparatus including a vibration device or a piezoelectric device.

BACKGROUND

Blowing apparatuses or electric fans may blow (or discharge) wind (or air) on the basis of a rotation of a fan (or a blowing wing) based on driving of a motor.

Blowing apparatuses have a problem where noise occurs due to a rotation of a motor or a fan.

The description provided in the discussion of the related art section should not be assumed to be prior art merely because it is mentioned in or associated with that section. The discussion of the related art section may include information that describes one or more aspects of the subject technology, and the description in this section does not limit the invention.

SUMMARY

The inventors have recognized the problems described above as well as the problems and disadvantages of the related art, have performed extensive research and experiments for implementing an apparatus which may blow (or discharge) wind (or air) by using a displacement amount of a vibration member (or a piezoelectric member) without noise. Through extensive research and experiments, the inventors have recognized that it is difficult to blow with a wind power (or strength) enabling a user to feel wind at a position apart therefrom by a certain distance (for example, 5 cm or more) because a wind power is weak, based on only a displacement amount of a vibration member (or a piezoelectric member) and have performed various experiments for enhancing a wind power of an apparatus including a vibration member (or a piezoelectric member). Through extensive research and experiments, the inventors have invented a new apparatus for enhancing a wind power generated based on a vibration of a vibration apparatus and a blowing apparatus including the new apparatus.

Accordingly, embodiments of the present disclosure are directed to a blowing apparatus that substantially obviates one or more of the problems due to limitations and disadvantages of the related art.

An aspect of the present disclosure is to provide an apparatus and a blowing apparatus including the same, which a wind power may be generated based on a vibration of a vibration apparatus.

Another aspect of the present disclosure is to provide an apparatus and a blowing apparatus including the same, which may blow (or discharge) wind (or air) without noise, based on a vibration of an ultra-low-pitched sound band of a vibration apparatus.

Another aspect of the present disclosure is to provide an apparatus and a blowing apparatus including the same, which may enhance the linearity of wind (or air) generated based on a vibration of a vibration apparatus.

Additional features and aspects will be set forth in the description that follows, and in part will be apparent from the description, or may be learned by practice of the inventive concepts provided herein. Other features and aspects of the inventive concepts may be realized and attained by the structure particularly pointed out in the written description, or derivable therefrom, and the claims hereof as well as the appended drawings.

To achieve these and other aspects of the inventive concepts, as embodied and broadly described herein, a blowing apparatus may comprise a housing including an accommodating space and one or more blowing holes, and a vibration apparatus in the accommodating space, wherein the vibration apparatus comprises a first active vibration member, a second active vibration member connected to an inner lateral surface of the housing and connected to intersect with the first active vibration member, and a passive vibration member between the one or more blowing holes and the first active vibration member and connected to the first active vibration member.

In another aspect, a blowing apparatus may comprise a housing including an accommodating space and one or more first and second blowing holes parallel to one another, and a vibration apparatus in the accommodating space, wherein the vibration apparatus comprises a first active vibration member, a second active vibration member connected to an inner lateral surface of the housing and connected to intersect with the first active vibration member, a first passive vibration member between the one or more first blowing holes and the first active vibration member and connected to the first active vibration member, and a second passive vibration member between the one or more second blowing holes and the first active vibration member and connected to the first active vibration member.

In another aspect, a blowing apparatus may comprise a housing including an accommodating space and one or more blowing holes; and a vibration apparatus in the accommodating space, wherein the vibration apparatus comprises: a first active vibration member; a second active vibration member connected to an inner lateral surface of the housing and connected to intersect with the first active vibration member; a passive vibration member between the one or more blowing holes and the first active vibration member and connected to the first active vibration member and the second active vibration member; a balance member disposed at the first active vibration member; a connection member between the passive vibration member and the second active vibration member; an adhesive member between the first active vibration member and the second active vibration member; and a mass member between the adhesive member and the second active vibration member.

An apparatus and a blowing apparatus including the same according to one or more example embodiments of the present disclosure may enhance a wind power generated based on a vibration of a vibration apparatus, and thus, may blow (or discharge) wind (or air) with a wind power (or strength) enabling a user to feel wind at a position apart therefrom by a certain distance (for example, 5 cm or more).

An apparatus and a blowing apparatus including the same according to one or more example embodiments of the present disclosure may blow (or discharge) wind (or air) without noise, based on a vibration of an ultra-low-pitched sound band of a vibration apparatus.

An apparatus and a blowing apparatus including the same according to one or more example embodiments of the present disclosure may enhance the linearity of wind (or air) generated based on a vibration of a vibration apparatus, and thus, may allow a wind direction to concentrate on a position apart therefrom by a certain distance (for example, 5 cm or more), thereby reinforcing a wind power (or strength).

Other systems, methods, features and advantages will be, or will become, apparent to one with skill in the art upon examination of the following figures and detailed description. It is intended that all such additional systems, methods, features and advantages be included within this description, be within the scope of the present disclosure, and be protected by the following claims. Nothing in this section should be taken as a limitation on those claims. Further aspects and advantages are discussed below in conjunction with aspects of the disclosure.

It is to be understood that both the foregoing description and the following description of the present disclosure are exemplary and explanatory and are intended to provide further explanation of the disclosure as claimed.

BRIEF DESCRIPTION OF THE DRAWINGS

The accompanying drawings, which are included to provide a further understanding of the disclosure, are incorporated in and constitute a part of this disclosure, illustrate aspects and embodiments of the disclosure and together with the description serve to explain principles of the disclosure.

Figure 1:
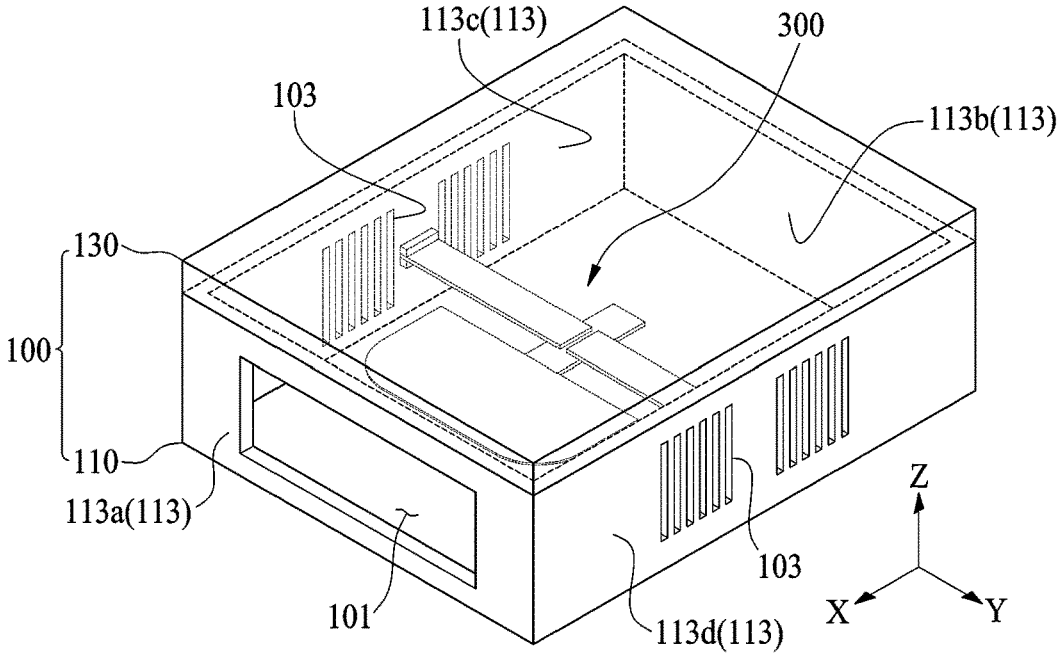
FIG. 1 illustrates an apparatus according to an embodiment of the present disclosure.

Throughout the drawings and the detailed description, unless otherwise described, the same drawing reference numerals should be understood to refer to the same elements, features, and structures. The sizes, lengths, and thicknesses of layers, regions and elements, and depiction thereof may be exaggerated for clarity, illustration, and convenience.

DETAILED DESCRIPTION

Reference is now made in detail to embodiments of the present disclosure, examples of which may be illustrated in the accompanying drawings. In the following description, when a detailed description of well-known functions or configurations may unnecessarily obscure aspects of the present disclosure, the detailed description thereof may be omitted for brevity. The progression of processing steps and/or operations described is an example; however, the sequence of steps and/or operations is not limited to that set forth herein and may be changed, with the exception of steps and/or operations necessarily occurring in a particular order.

Unless stated otherwise, like reference numerals may refer to like elements throughout even when they are shown in different drawings. In one or more aspects, identical elements (or elements with identical names) in different drawings may have the same or substantially the same functions and properties unless stated otherwise. Names of the respective elements used in the following explanations are selected only for convenience and may be thus different from those used in actual products.

Advantages and features of the present disclosure, and implementation methods thereof are clarified through the embodiments described with reference to the accompanying drawings. The present disclosure may, however, be embodied in different forms and should not be construed as limited to the embodiments set forth herein.

The shapes, sizes, areas, ratios, angles, numbers, and the like disclosed in the drawings for describing embodiments of the present disclosure are merely example, and thus, the present disclosure is not limited to the illustrated details.

When the term "comprise," "have," "include," "contain," "constitute," "make up of," "formed of," and the like is used, one or more other elements may be added unless the term such as "only" or the like is used. The terms used in the present disclosure are merely used in order to describe particular embodiments, and are not intended to limit the scope of the present disclosure. The terms used herein are merely used in order to describe example embodiments, and are not intended to limit the scope of the present disclosure. The terms of a singular form may include plural forms unless the context clearly indicates otherwise. The word "exemplary" is used to mean serving as an example or illustration. Embodiments are example embodiments. Aspects are example aspects. Any implementation described herein as an "example" is not necessarily to be construed as preferred or advantageous over other implementations.

In one or more aspects, an element, feature, or corresponding information (e.g., a level, range, dimension, size, or the like) is construed as including an error or tolerance range even where no explicit description of such an error or tolerance range is provided. An error or tolerance range may be caused by various factors (e.g., process factors, internal or external impact, noise, or the like). Further, the term "may" encompasses all the meanings of the term "can."

In describing a positional relationship, where the positional relationship between two parts is described using "on," "over," "under," "above," "below," "beneath," "near," "close to," or "adjacent to," "beside," "next to," or the like, one or more other parts may be disposed between the two parts unless a more limiting term, such as ""immediate(ly)," "direct(ly)," or "close(ly)" is used. For example, when a structure is described as being positioned "on," "over," "under," "above," "below," "beneath," "near," "close to," or "adjacent to," "beside," or "next to" another structure, this description should be construed as including a case in which the structures contact each other as well as a case in which one or more additional structures are disposed or interposed therebetween. Furthermore, the terms "front," "rear," "left," "right," "top," "bottom, "downward," "upward," "upper," "lower," and the like refer to an arbitrary frame of reference.

In describing a temporal relationship, when the temporal order is described using "after," "subsequent," "next," "before," "prior to," or the like, a case that is not consecutive or not sequential may be included unless a more limiting term, such as "just," "immediate(ly)," or "direct(ly)," is used.

It is understood that, although the term "first," "second," or the like may be used herein to describe various elements, these elements should not be limited by these terms. These terms are only used to distinguish one element from another. For example, a first element could be a second element, and, similarly, a second element could be a first element, without departing from the scope of the present disclosure. Furthermore, the first element, the second element, and the like may be arbitrarily named according to the convenience of those skilled in the art without departing from the scope of the present disclosure. The terms "first," "second," and the like may be used to distinguish components from each other, but the functions or structures of the components are not limited by ordinal numbers or component names in front of the components.

In describing elements of the present disclosure, the terms "first," "second," "A," "B," "(a)," "(b)," or the like may be used. These terms are intended to identify the corresponding element(s) from the other element(s), and these are not used to define the essence, basis, order, or number of the elements.

For the expression that an element or layer is "connected," "coupled," or "adhered" to another element or layer, the element or layer can not only be directly connected, coupled, or adhered to another element or layer, but also be indirectly connected, coupled, or adhered to another element or layer with one or more intervening elements or layers disposed or interposed between the elements or layers, unless otherwise specified.

For the expression that an element or layer "contacts," "overlaps," or the like with another element or layer, the element or layer can not only directly contact, overlap, or the like with another element or layer, but also indirectly contact, overlap, or the like with another element or layer with one or more intervening elements or layers disposed or interposed between the elements or layers, unless otherwise specified.

The term "at least one" should be understood as including any and all combinations of one or more of the associated listed items. For example, the meaning of "at least one of a first items, a second item, and a third item" denotes the combination of items proposed from two or more of the first item, the second item, and the third item as well as only one of the first item, the second item, or the third item. The expression of a first element, a second elements "and/or" a third element should be understood as one of the first, second and third elements or as any or all combinations of the first, second and third elements. By way of example, A, B and/or C can refer to only A; only B; only C; any or some combination of A, B, and C; or all of A, B, and C. Furthermore, an expression "element A/element B" may be understood as element A and/or element B.

In one or more aspects, the terms "between" and "among" may be used interchangeably simply for convenience unless stated otherwise. For example, an expression "between a plurality of elements" may be understood as among a plurality of elements. In another example, an expression "among a plurality of elements" may be understood as between a plurality of elements. In one or more examples, the number of elements may be two. In one or more examples, the number of elements may be more than two.

In one or more aspects, the phrases "each other" and "one another" may be used interchangeably simply for convenience unless stated otherwise. For example, an expression "different from each other" may be understood as being different from one another. In another example, an expression "different from one another" may be understood as being different from each other. In one or more examples, the number of elements involved in the foregoing expression may be two. In one or more examples, the number of elements involved in the foregoing expression may be more than two.

In one or more aspects, the phrases "one or more among" and "one or more of" may be used interchangeably simply for convenience unless stated otherwise. In one or more aspects, unless stated otherwise, the term "nth" or "$n^{th}$" may refer to "nnd" or "$n^{nd}$" (e.g., 2nd where n is 2), or "$n^{rd}$" or (e.g., 3rd where n is 3), and n may be a natural number.

Features of various embodiments of the present disclosure may be partially or wholly coupled to or combined with each other, and may be variously inter-operated, linked or driven together. The embodiments of the present disclosure may be carried out independently from each other, or may be carried out together in a co-dependent or related relationship. In one or more aspects, the components of each apparatus according to various embodiments of the present disclosure are operatively coupled and configured.

Unless otherwise defined, the terms (including technical and scientific terms) used herein have the same meaning as commonly understood by one of ordinary skill in the art to which example embodiments belong. It is further understood that terms, such as those defined in commonly used dictionaries, should be interpreted as having a meaning that is, for example, consistent with their meaning in the context of the relevant art and should not be interpreted in an idealized or overly formal sense unless expressly defined otherwise herein.

Hereinafter, various example embodiments of the present disclosure are described in detail with reference to the accompanying drawings. With respect to reference numerals to elements of each of the drawings, although the same elements may be illustrated in other drawings, like reference numerals may refer to like elements unless stated otherwise. In addition, for convenience of description, a scale, dimension, size and thickness of each of the elements illustrated in the accompanying drawings may differ from an actual scale, dimension, size, and thickness, and thus, embodiments of the present disclosure are not limited to a scale, dimension, size, and thickness, illustrated in the drawings.

Figure 2:
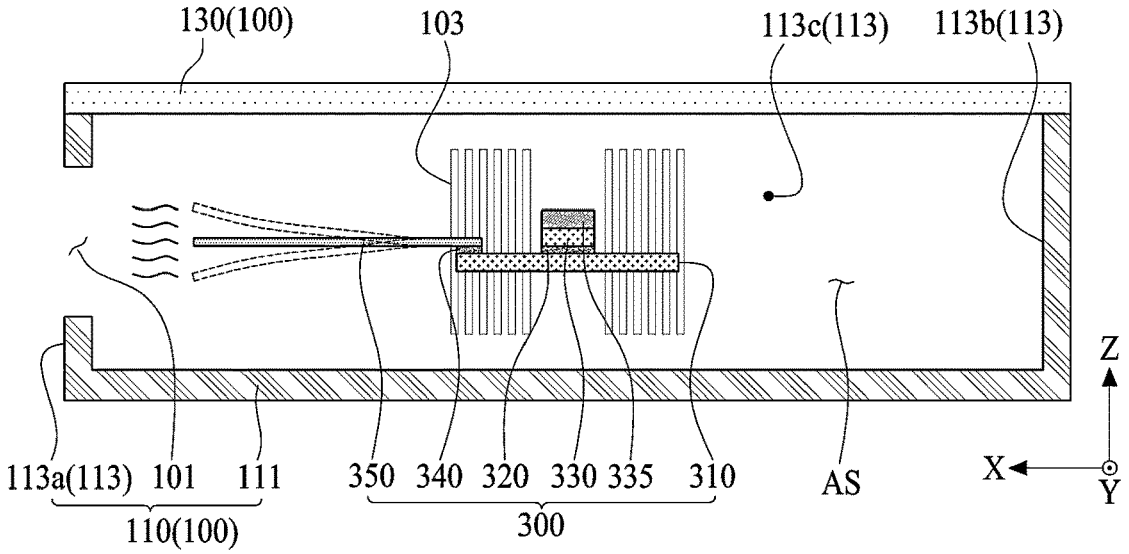
FIG. 2 is a cross-sectional view of the apparatus illustrated in FIG. 1.

FIG. 1 illustrates an apparatus according to an embodiment of the present disclosure. FIG. 2 is a cross-sectional view of the apparatus illustrated in FIG. 1.

With reference to FIGS. 1 and 2, the apparatus according to an embodiment of the present disclosure may include a housing 100 and a vibration apparatus 300.

The housing 100 may be a main body, a body, or a case of the apparatus, but embodiments of the present disclosure are not limited thereto. For example, the housing 100 may include a box shape including an accommodation space AS, one or more blowing holes 101, and one or more suction portions (or air suction portions) 103. The housing 100 according to an embodiment of the present disclosure may include a first housing 110 and a second housing 130.

The first housing 110 may be a first case, a lower case, a lower frame, or a lower body, but embodiments of the present disclosure are not limited thereto. The first housing 110 may include a floor portion 111 and a sidewall portion 113.

The floor portion 111 may be a floor frame or a lower cover having a certain size. The sidewall portion 113 may be connected to a periphery portion of the floor portion 111. For example, the sidewall portion 113 may have a certain height and may be connected to be vertical to the periphery portion of the floor portion 111. The sidewall portion 113 may be implemented to have a certain height along the periphery portion of the floor portion 111, and thus, may provide the accommodating space AS over the floor portion 111. Accordingly, the first housing 110 may include a box shape including a front opening portion (or an upper opening portion).

The sidewall portion 113 may include a plurality of sidewall portions 113*a*, 113*b*, 113*c*, and 113*d*. The sidewall portion 113 may include first to fourth sidewall portions 113*a*, 113*b*, 113*c*, and 113*d*. The first sidewall portion 113*a* may implement a first short side (or a first long side) of the housing 100 or a first lateral portion of the housing 100. The second sidewall portion 113*b* may implement a second short side (or a second long side) of the housing 100 or a second lateral portion of the housing 100. The third sidewall portion 113*c* may implement the first long side (or the first short side) of the housing 100 or a third lateral portion of the housing 100. The fourth sidewall portion 113*d* may implement the second long side (or the second short side) of the housing 100 or a fourth lateral portion of the housing 100. For example, each of the first and second long sides of the housing 100 (or a first housing 110) may be parallel to a first direction X and each of the first and second short sides of the housing 100 (or the first housing 110) may be parallel to a second direction Y intersecting with the first direction X, but embodiments of the present disclosure are not limited thereto.

The second housing 130 may be disposed on the first housing 110. The second housing 130 may be connected to a sidewall portion 113 of the first housing 110 to cover the accommodating space AS of the first housing 110. For example, the second housing 130 may be detachably connected to the first housing 110. For example, the second housing 130 may be a second case, an upper case, an upper frame, an upper body, an upper cover, a cover frame, or a cover plate, but embodiments of the present disclosure are not limited thereto.

The housing 100 according to an embodiment of the present disclosure may include the one or more blowing holes 101 and the one or more suction portions 103.

The one or more blowing holes 101 may be disposed at one of a plurality of lateral portions which implement a lateral surface of the housing 100. For example, the one or more blowing holes 101 may be implement to pass through a first lateral portion (or the first sidewall portion 113*a*) of the first to fourth lateral portions of the housing 100. For example, the one or more blowing holes 101 may be implemented to pass through the first lateral portion of the housing 100 along the first direction X and extend long along the second direction Y. For example, the one or more blowing holes 101 may include one or more slots or slits. Optionally, an air filter may be disposed at the one or more blowing holes 101.

The one or more suction portions 103 may be disposed at one or more of the other lateral portions, except one lateral portion where the blowing hole 101 is disposed, of the plurality of lateral portions which implement the lateral surface of the housing 100. As an embodiment of the present disclosure, the one or more suction portions 103 may be implemented to pass through one or more of the second to fourth lateral portions of the housing 100. For example, the one or more suction portions 103 may be implemented to pass through each of the third and fourth lateral portions of the housing 100. As another embodiment of the present disclosure, the one or more suction portions 103 may be implemented to pass through the second housing 130 of the housing 100 along a third direction Z. For example, the third direction Z may be parallel to a thickness (or height) direction of the housing 100. The one or more suction portions 103 may include one or more slots or slits. Optionally, an air filter may be disposed at the one or more suction portions 103.

The vibration apparatus 300 may be disposed in the accommodating space AS of the housing 100 and may be implemented to vibrate (or displace or drive) based on a driving signal input thereto to blow (or discharge) wind (or air) through the one or more blowing holes 101. The vibration apparatus 300 may be implemented to have a vibration frequency corresponding to a frequency of an ultra-low-pitched sound band inaudible to a user. For example, the vibration apparatus 300 may be implemented to have a vibration frequency corresponding to a frequency of an ultra-low-pitched sound band of 100 Hz or less. For example, the vibration apparatus 300 may be implemented to have a lowest vibration number (or a lowest vibration frequency) of several Hz to tens Hz, and thus, may vibrate with a noise sound inaudible to a user to generate wind (or air) and may blow (or discharge) the wind (or the air) to the outside through the one or more blowing holes 101.

The vibration apparatus 300 may be connected across between inner surfaces of the third and fourth lateral portions of the housing 100 to face the one or more blowing holes 101 of the housing 100. The vibration apparatus 300 may be implemented in the accommodating space AS of the housing 100 to generate wind (or air) according to a vibration of a passive vibration member 350 based on a composite vibration (or displacement or driving) of a plurality of active vibration members 310 and 330. For example, the plurality of active vibration members 310 and 330 and the passive vibration member 350 may be implemented to have a composite structure of a 2-degree-of-freedom vibration model.

Figure 3:
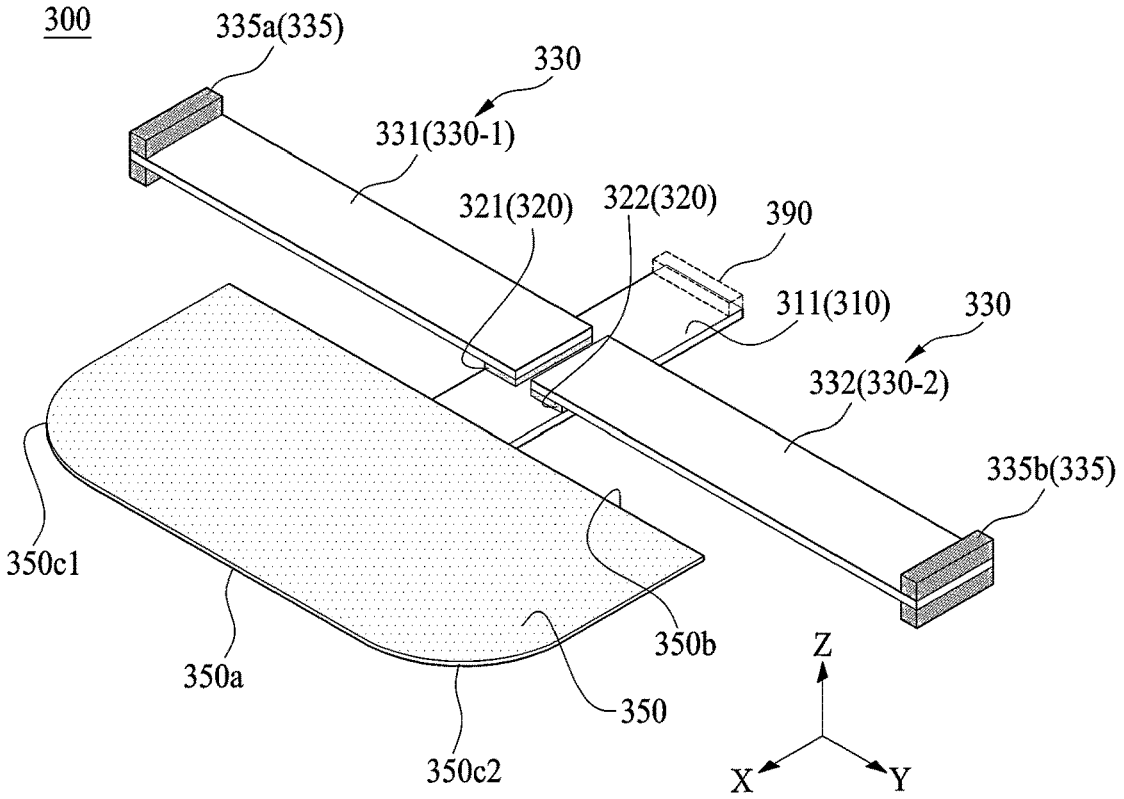
FIG. 3 is a perspective view illustrating the vibration apparatus 300 according to an embodiment of the present disclosure illustrated in FIGS. 1 and 2.

FIG. 3 is a perspective view illustrating the vibration apparatus 300 according to an embodiment of the present disclosure illustrated in FIGS. 1 and 2.

With reference to FIGS. 1 to 3, the vibration apparatus 300 according to an embodiment of the present disclosure may include first and second active vibration members 310 and 330 connected to each other and to intersect with each other, and a passive vibration member 350 connected to the first active vibration member 310.

The first active vibration member 310 may be disposed at the accommodating space AS of the housing 100. For example, the first active vibration member 310 may be disposed in the accommodating space AS of the housing 100 in parallel with the first direction X. For example, the first active vibration member 310 may be disposed between the floor portion 111 of the first housing 110 and the second housing 130 in the accommodating space AS of the housing 100. The first active vibration member 310 may be connected to the passive vibration member 350 in the accommodating space AS of the housing 100. The first active vibration member 310 may include one first vibration device 311. For example, the one first vibration device 311 may be connected to the passive vibration member 350.

The second active vibration member 330 may be disposed to intersect with the first active vibration member 310 and to be connected to the first active vibration member 310. The second active vibration member 330 may be disposed in the accommodating space AS of the housing 100 in parallel with the second direction Y intersecting with the first active vibration member 310 and may be connected to the first active vibration member 310. The second active vibration member 330 may be connected to a center portion of the first active vibration member 310. A portion of the second active vibration member 330 may be connected to the first active vibration member 310.

The second active vibration member 330 may include a 2-1$^{st}$ active vibration member 330-1 and a 2-2$^{nd}$ active vibration member 330-2, which are each connected to the first active vibration member 310 and each connected to an inner lateral surface of the housing 100. The 2-1$^{st}$ active vibration member 330-1 and the 2-2$^{nd}$ active vibration member 330-2 may be arranged along a direction intersecting with the first active vibration member 310 and may be spaced apart from each other over the first active vibration member 310. For example, the 2-1$^{st}$ active vibration member 330-1 and the 2-2$^{nd}$ active vibration member 330-2 may be a pair of second active vibration members. In the present disclosure, 2-1$^{st}$ active vibration member 330-1 and the 2-2$^{nd}$ active vibration member 330-2 may be a second active vibration member and a third active vibration member, but embodiments of the present disclosure are not limited to digits "2-1" and "2-2$^{nd}$".

The 2-1$^{st}$ active vibration member 330-1 may include a 2-1$^{st}$ vibration device 331, and the 2-2$^{nd}$ active vibration member 330-2 may include a 2-2$^{nd}$ vibration device 332. For example, the 2-1$^{st}$ vibration device 331 and the 2-2$^{nd}$ vibration device 332 may be a pair of second vibration devices. The 2-1$^{st}$ vibration device 331 and the 2-2$^{nd}$ vibration device 332 may be arranged in parallel with each other along a direction intersecting with the first vibration device 311 and may be spaced apart from each other over the first vibration device 311. For example, the 2-1$^{st}$ vibration device 331 and the 2-2$^{nd}$ vibration device 332 may be spaced apart from each other over a center portion of the first vibration device 311. In the present disclosure, the 2-1$^{st}$ vibration device 331 and the 2-2$^{nd}$ vibration device 332 may be a second vibration device (or a vibration apparatus) and a third vibration device (or a vibration apparatus), but embodiments of the present disclosure are not limited to digits "2-1" and "2-2$^{nd}$".

The first vibration device 311, the 2-1$^{st}$ vibration device 331 and the 2-2$^{nd}$ vibration device 332 may each have a tetragonal shape including a short side and a long side, and for example, may have a rectangular shape. Each of the first vibration device 311, the 2-1$^{st}$ vibration device 331 and the 2-2$^{nd}$ vibration device 332 may have the same length, but embodiments of the present disclosure are not limited. For example, each of the first vibration device 311, the 2-1$^{st}$ vibration device 331 and the 2-2$^{nd}$ vibration device 332 may have the same length within a length which enables arrangement in a gap space GS.

The first vibration device 311 may be disposed to intersect with each of the 2-1$^{st}$ vibration device 331 and the 2-2$^{nd}$ vibration device 332. For example, the first vibration device 311, the 2-1$^{st}$ vibration device 331 and the 2-2$^{nd}$ vibration device 332 may be two-dimensionally arranged in a "+"-shape, but embodiments of the present disclosure are not limited.

Each of the first vibration device 311, the 2-1$^{st}$ vibration device 331 and the 2-2$^{nd}$ vibration device 332 may include first and second periphery portions which are parallel with each other with the center portion (or intersection portion) therebetween. A center portion of the first vibration device 311 may overlap the first periphery portion of each of the 2-1$^{st}$ vibration device 331 and the 2-2$^{nd}$ vibration device 332. Accordingly, the center portion of the first vibration device 311 may not overlap a center portion of each of the 2-1$^{st}$ vibration device 331 and the 2-2$^{nd}$ vibration device 332 and may be disposed between the center portions of each of the 2-1$^{st}$ vibration device 331 and the 2-2$^{nd}$ vibration device 332.

One of first and second periphery portions of the first vibration device 311 may be connected to the passive vibration member 350. One periphery portion, which is close to the blow hole 101 of the housing 100, of first and second periphery portions of the first vibration device 311 may be connected to the passive vibration member 350. For example, the first periphery portion of the first vibration device 311 may be connected to the passive vibration member 350.

The first periphery portion of each of the 2-1$^{st}$ vibration device 331 and the 2-2$^{nd}$ vibration device 332 may be spaced apart from each other and may be respectively connected to the center portion of the first vibration device 311. The second periphery portion of each of the 2-1$^{st}$ vibration device 331 and the 2-2$^{nd}$ vibration device 332 may be spaced apart from each other and may be respectively connected to the inner lateral surface of the housing 100. For example, the second periphery portion of the 2-1$^{st}$ vibration device 331 may be connected to an inner lateral surface of the third lateral portion of the housing 100, and the second periphery portion of the 2-2$^{nd}$ vibration device 332 may be connected to an inner lateral surface of the fourth lateral portion of the housing 100. For example, the second periphery portion of each of the 2-1$^{st}$ vibration device 331 and the 2-2$^{nd}$ vibration device 332 may be connected to the inner lateral surface of the housing 100 to have a cantilever structure.

Each of the first vibration device 311, the 2-1$^{st}$ vibration device 331 and the 2-2$^{nd}$ vibration device 332 may be a flexural displacement type vibration device (or piezoelectric vibration device). For example, each of the first vibration device 311, the 2-1$^{st}$ vibration device 331 and the 2-2$^{nd}$ vibration device 332 may be a single-layer vibration device (or piezoelectric vibration device) or a stack type vibration device (or piezoelectric vibration device), but embodiments of the present disclosure are not limited.

Each of the first vibration device 311, the 2-1$^{st}$ vibration device 331 and the 2-2$^{nd}$ vibration device 332 may vibrate (or displace or drive) based on a driving signal input thereto. Each of the first vibration device 311, the 2-1$^{st}$ vibration device 331 and the 2-2$^{nd}$ vibration device 332 may vibrate (or displace or drive) as contraction and expansion are alternately repeated based on a piezoelectric effect (or a piezoelectric characteristic) according to a driving signal applied from the outside. The driving signal may be an alternating current (AC) signal such as a sound signal, a vibration driving signal, or a voice signal, or the like. The 2-1$^{st}$ vibration device 331 and the 2-2$^{nd}$ vibration device 332 may vibrate (or displace or drive) based on the same driving signal. The driving signal applied to 2-1$^{st}$ vibration device 331 and the 2-2$^{nd}$ vibration device 332 may have the same phase (or in-phase) as a driving signal applied to the first vibration device 311, or may have opposite phases (or anti-phases) with respect to a phase of the driving signal applied to the first vibration device 311.

Each of the first vibration device 311, the 2-1$^{st}$ vibration device 331 and the 2-2$^{nd}$ vibration device 332 may include one or more piezoelectric devices. The one or more piezoelectric devices may include a piezoelectric layer, one or more first electrodes disposed at a first surface of the piezoelectric layer, and one or more second electrodes disposed at a second surface different from the first surface of the piezoelectric layer. For example, the piezoelectric layer may include a front surface and a rear surface. For example, the first surface of the piezoelectric layer may be a first region of the front surface (or the rear surface) of the piezoelectric layer, and the second surface of the piezoelectric layer may be a second region, which is spaced apart from the first region of the front surface (or the rear surface) of the piezoelectric layer. For example, the first surface of the piezoelectric layer may be the front surface of the piezoelectric layer, and the second surface of the piezoelectric layer may be the rear surface of the piezoelectric layer.

In each of the first vibration device 311, the 2-1$^{st}$ vibration device 331 and the 2-2$^{nd}$ vibration device 332, the piezoelectric device may include a piezoelectric layer. Material of the piezoelectric layer is not limited thereto, but may include a piezoelectric material of a ceramic-based material capable of implementing a relatively high vibration, or may include a piezoelectric ceramic material having a perovskite-based crystal structure. For example, the piezoelectric layer may be configured as a piezoelectric material including lead (Pb) or a piezoelectric material not including lead (Pb). For example, the piezoelectric material including lead (Pb) may include one or more of a lead zirconate titanate (PZT)-based material, a lead zirconate nickel niobate (PZNN)-based material, a lead magnesium niobate (PMN)-based material, a lead nickel niobate (PNN)-based material, a lead zirconate niobate (PZN)-based material, or a lead indium niobate (PIN)-based material, but embodiments of the present disclosure are not limited thereto. For example, the piezoelectric material not including lead (Pb) may include one or more of barium titanate ($BaTiO_3$), calcium titanate ($CaTiO_3$), and strontium titanate ($SrTiO_3$), but embodiments of the present disclosure are not limited thereto.

The vibration apparatus 300 according to an embodiment of the present disclosure may further include a first adhesive members 320 and a coupling member 335.

The first adhesive member 320 may be disposed between the first and second active vibration members 310 and 330. For example, the first adhesive member 320 may be disposed between the first active vibration member 310 and each of the 2-1$^{st}$ active vibration member 330-1 and the 2-2$^{nd}$ active vibration member 330-2. For example, the first adhesive member 320 may be disposed between a pair of second active vibration members 330-1 and 330-2 and the first active vibration member 310. Accordingly, each of the 2-1$^{st}$ active vibration member 330-1 and the 2-2$^{nd}$ active vibration member 330-2 may be connected to the first active vibration member 310 by the first adhesive member 320, and thus, may receive a vibration (or displacement) of the first active vibration member 310 to vibrate (or displace or drive).

The first adhesive member 320 may be disposed between the first vibration device 311 of the first active vibration member 310 and each of the 2-1$^{st}$ vibration device 331 of the 2-1$^{st}$ active vibration member 330-1 and the 2-2$^{nd}$ vibration device 332 of the 2-2$^{nd}$ active vibration member 330-2. For example, the first adhesive member 320 may be disposed between a pair of second vibration devices 331 and 332 and the first vibration device 311. Accordingly, each of the 2-1$^{st}$ vibration device 331 and the 2-2$^{nd}$ vibration device 332 may be connected to the first vibration device 311 by the first adhesive member 320, and thus, may receive a vibration (or displacement) of the first vibration device 311 to vibrate (or displace or drive).

The first adhesive member 320 according to an embodiment of the present disclosure may include a 1-1$^{st}$ adhesive member 321 and a 1-2$^{nd}$ adhesive member 322. For example, the 1-1$^{st}$ adhesive member 321 and the 1-2$^{nd}$ adhesive member 322 may be a pair of adhesive members. In the present disclosure, the 1-1$^{st}$ adhesive member 321 and the 1-2$^{nd}$ adhesive member 322 may be a first adhesive member and a second adhesive member, but embodiments of the present disclosure are not limited to digits "1-1" and "1-2$^{nd}$".

The 1-1$^{st}$ adhesive member (or 1-1$^{st}$ adhesive portion) 321 may be adhered between the first periphery portion of the 2-1$^{st}$ vibration device 331 and the first vibration device 311. The 1-1$^{st}$ adhesive member 321 may be adhered between the first periphery portion of the 2-1$^{st}$ vibration device 331 and a first side (or first portion) of the center portion of the first vibration device 311. Accordingly, the first periphery portion of the 2-1$^{st}$ vibration device 331 may be connected to the center portion of the first vibration device 311 by the 1-1$^{st}$ adhesive member 321, and thus, may receive a vibration (or displacement) of the first vibration device 311 to vibrate (or displace or drive).

The 1-2$^{nd}$ adhesive member (or 1-2$^{nd}$ adhesive portion) 322 may be adhered between the first periphery portion of the 2-2$^{nd}$ vibration device 332 and the first vibration device 311. The 1-2$^{nd}$ adhesive member 322 may be adhered between the first periphery portion of the 2-2$^{nd}$ vibration device 332 and a second side (or second portion) of the center portion of the first vibration device 311. Accordingly, the first periphery portion of the 2-2$^{nd}$ vibration device 332 may be connected to the center portion of the first vibration device 311 by the 1-2$^{nd}$ adhesive member 322, and thus, may receive a vibration (or displacement) of the first vibration device 311 to vibrate (or displace or drive). Accordingly, the first periphery portion of each of the 2-1$^{st}$ vibration device 331 and the 2-2$^{nd}$ vibration device 332 may vibrate (or displace or drive) together based on a vibration (or displacement) of the first vibration device 311.

According to another embodiment of the present disclosure, the first adhesive member 320 may not be divided into the 1-1$^{st}$ adhesive member 321 and the 1-2$^{nd}$ adhesive member 322 and may be attached at the whole center portion of the first vibration device 311. Accordingly, the first periphery portion of the 2-1$^{st}$ vibration device 331 and the second periphery portion of the 2-2$^{nd}$ vibration device 332 may be commonly connected to the one first adhesive member 320 disposed at the whole center portion of the first vibration device 311 and may be spaced apart from each other over the one first adhesive member 320.

The first adhesive members 320, 321, and 322 may be configured as an adhesive material capable of compression and decompression. For example, the adhesive members 320, 321, and 322 may be configured as an adhesive material which is low in elastic modulus. The adhesive members 320, 321, and 322 may be configured as an adhesive resin material, an adhesive, or an adhesive tape, or the like, but embodiments of the present disclosure are not limited thereto. The adhesive resin material may include one of an epoxy-based resin material, an acrylic-based resin material, a silicone-based resin material, or urethane-based resin material, but embodiments of the present disclosure are not limited thereto. For example, the adhesive members 320, 321, and 322 may include an acrylic-based adhesive material having a characteristic which is relatively good in adhesive force and high in hardness of acrylic and urethane so that a vibration of the first vibration device 311 is well transferred to the first periphery portion of each of the 2-1$^{st}$ vibration device 331 and the 2-2$^{nd}$ vibration device 332.

The coupling member 335 may be coupled to the inner lateral surface of the housing 100 and may be implemented to support the second active vibration member 330. The coupling member 335 may be coupled to the inner lateral surface of the housing 100 and may support the second periphery portion of each of the 2-1$^{st}$ vibration device 331 and the 2-2$^{nd}$ vibration device 332.

The coupling member 335 according to an embodiment of the present disclosure may include a first coupling member 335*a* and a second coupling member 335*b*. For example, the coupling member 335 may be a connection portion, a supporting portion, a supporting member, an elastic connection portion, an elastic supporting portion, or an elastic member. For example, the first coupling member 335*a* and the second coupling member 335*b* may be a pair of coupling members. For example, the first coupling member 335*a* may be a first connection portion, a first supporting portion, a first supporting member, a first elastic connection portion, a first elastic supporting portion, or a first elastic member. For example, the second coupling member 335*b* may be a second connection portion, a second supporting portion, a second supporting member, a second elastic connection portion, a second elastic supporting portion, or a second elastic member.

The first coupling member 335*a* may be implemented to connect the second periphery portion of the 2-1$^{st}$ vibration device 331 to the inner lateral surface of the housing 100. For example, the first coupling member 335*a* may be implemented to connect the second periphery portion of the 2-1$^{st}$ vibration device 331 to the inner lateral surface of the third lateral portion of the housing 100. The first coupling member 335*a* may be connected (or attached) to the inner lateral surface of the third lateral portion of the housing 100 and may be connected to the second periphery portion of the 2-1$^{st}$ vibration device 331. For example, the first coupling member 335*a* may movably (or vibratility) support the second periphery portion of the 2-1$^{st}$ vibration device 331. For example, the first coupling member 335*a* may elastically or flexibly support the second periphery portion of the 2-1$^{st}$ vibration device 331.

The first coupling member 335*a* according to an embodiment of the present disclosure may be connected (or coupled) to at least a portion of the second periphery portion of the 2-1$^{st}$ vibration device 331. For example, the first coupling member 335*a* may be connected (or coupled) to each of a front surface and a rear surface, which face or are opposite to each other, of the second periphery portion of the 2-1$^{st}$ vibration device 331. For example, the first coupling member 335*a* may be connected (or coupled) to surround the second periphery portion of the 2-1$^{st}$ vibration device 331. For example, the second periphery portion of the 2-1$^{st}$ vibration device 331 may be inserted into the first coupling member 335*a*. Accordingly, the second periphery portion of the 2-1$^{st}$ vibration device 331 may be vibratility (or displaceably) connected to the inner lateral surface of the housing 100 by the first coupling member 335*a* to have the cantilever structure.

The second coupling member 335*b* may be implemented to connect the second periphery portion of the 2-2$^{nd}$ vibration device 332 to the inner lateral surface of the housing 100. For example, the second coupling member 335*b* may be implemented to connect the second periphery portion of the 2-2$^{st}$ vibration device 332 to the inner lateral surface of the fourth lateral portion of the housing 100. The second coupling member 335*b* may be connected (or attached) to the inner lateral surface of the fourth lateral portion of the housing 100 and may be connected to the second periphery portion of the 2-2$^{nd}$ vibration device 332. For example, the second coupling member 335*b* may movably (or vibratility) support the second periphery portion of the 2-2$^{nd}$ vibration device 332. For example, the second coupling member 335*b* may elastically or flexibly support the second periphery portion of the 2-2$^{nd}$ vibration device 332.

The second coupling member 335*b* according to an embodiment of the present disclosure may be connected (or coupled) to at least a portion of the second periphery portion of the 2-2$^{nd}$ vibration device 332. For example, the second coupling member 335*b* may be connected (or coupled) to each of a front surface and a rear surface, which face or are opposite to each other, of the second periphery portion of the 2-2$^{nd}$ vibration device 332. For example, the second coupling member 335*b* may be connected (or coupled) to surround the second periphery portion of the 2-2$^{nd}$ vibration device 332. For example, the second periphery portion of the 2-2$^{nd}$ vibration device 332 may be inserted into the second coupling member 335*b*. Accordingly, the second periphery portion of the 2-2$^{nd}$ vibration device 332 may be vibratility (or displaceably) connected to the inner lateral surface of the housing 100 by the second coupling member 335*b* to have the cantilever structure.

The coupling members 335, 335*a*, and 335*b* according to an embodiment of the present disclosure may include an elastic material having elasticity or flexibility. The coupling members 335, 335*a*, and 335*b* may be configured as an elastic body having an elastic modulus (or Young's modulus) which is lower than each of the vibration devices 311, 331, and 332. For example, the coupling members 335, 335*a*, and 335*b* may include a double-sided tape, a single-sided tape, a double-sided foam tape, or a double-sided adhesive foam pad, but embodiments of the present disclosure are not limited thereto. For example, the coupling members 335, 335*a*, and 335*b* may include an elastic pad such as a rubber pad or a silicone pad, or the like, which has adhesive properties and is capable of compression and decompression. For example, an adhesive layer of the coupling members 335, 335*a*, and 335*b* may include an acrylic adhesive material having a characteristic which is relatively good in adhesive force and high in hardness.

The passive vibration member 350 may be connected to the first periphery portion of the first active vibration member 310 and may be disposed between the blowing hole 101 of the housing 100 and the first active vibration member 310. The passive vibration member 350 may vibrate based on a displacement (or vibration or driving) of the first active vibration member 310 to generate wind. For example, the passive vibration member 350 may vibrate based on the displacement (or vibration or driving) of the first active vibration member 310 to blow wind (or air) to the outside through the blowing hole 101 of the housing 100. For example, the passive vibration member 350 may be a wind generating member, a blowing member, a wing member, a blowing wing, a vibration plate, a wind generating plate, a blowing plate, or a fan, but embodiments of the present disclosure are not limited thereto.

The passive vibration member 350 may blow (or discharge) wind (or air) without noise, based on a vibration of an ultra-low-pitched sound band. For example, the passive vibration member 350 may vibrate at a vibration frequency corresponding to a frequency of an ultra-low-pitched sound band inaudible to a user. For example, the passive vibration member 350 may vibrate at a vibration frequency corresponding to a frequency of an ultra-low-pitched sound band of 100 Hz or less. For example, the passive vibration member 350 may vibrate at a lowest vibration number (or a lowest vibration frequency) of several Hz to tens Hz, and thus, may vibrate with a noise sound inaudible to a user to generate wind (or air).

The passive vibration member 350 according to an embodiment of the present disclosure may include a material which is relatively lightweight and has flexibility. For example, the passive vibration member 350 according to an embodiment of the present disclosure may include one or more materials of wood, rubber, plastic, fiber, cloth, paper, flexible metal, and leather, but embodiments of the present disclosure are not limited thereto.

The passive vibration member 350 according to an embodiment of the present disclosure may have a square shape or a rectangular shape, but embodiments of the present disclosure are not limited thereto and may have a polygonal shape, a non-polygonal shape, a semicircular shape, or a semi-oval shape. For example, the passive vibration member 350 may have a rectangular shape where a first side (or a first long side) faces the blowing hole 101 of the housing 100 and each of both corner portions 350*c*1 and 350*c*2 of the first side 350*a* is rounded in a curved shape.

The vibration apparatus 300 according to an embodiment of the present disclosure may further include a second adhesive members 340.

The second adhesive member 340 may be disposed between the first active vibration member 310 and the passive vibration member 350. For example, the second adhesive member 340 may be disposed between the first periphery portion of the first active vibration member 310 and the passive vibration member 350. The second adhesive member 340 may be disposed between the first vibration device 311 and the passive vibration member 350. For example, the second adhesive member 340 may be disposed between the first periphery portion of the first vibration device 311 and the passive vibration member 350.

The second adhesive member 340 according to an embodiment of the present disclosure may be configured as an adhesive material capable of compression and decompression. For example, the second adhesive member 340 may be configured as an adhesive material which is low in elastic modulus. The second adhesive member 340 may be configured as an adhesive resin material, an adhesive, or an adhesive tape, or the like, but embodiments of the present disclosure are not limited thereto. For example, the second adhesive member 340 may be configured as adhesive material which is substantially the same as the first adhesive member 320, but embodiments of the present disclosure are not limited thereto.

The apparatus or the vibration apparatus 300 according to an embodiment of the present disclosure may further include a balance member 390.

The balance member 390 may be disposed at the first active vibration member 310 in parallel with the passive vibration member 350 with the second active vibration member 330 therebetween. For example, when the passive vibration member 350 is connected to the first periphery portion of the first active vibration member 310, the balance member 390 may be disposed at the second periphery portion of the first active vibration member 310.

The balance member 390 may be disposed at the first vibration device 311 in parallel with the passive vibration member 350 with the second active vibration member 330 therebetween. For example, when the passive vibration member 350 is connected to the first periphery portion of the first vibration device 311, the balance member 390 may be disposed at the second periphery portion of the first vibration device 311.

The balance member according to an embodiment of the present disclosure may have substantially the same weight (or mass) as that of the passive vibration member 350. The balance member 390 may be balanced so that a center of weight of the first active vibration member 310 connected to the passive vibration member 350 is disposed at a center portion of the first active vibration member 310. For example, the balance member 390 may balance a center of weight of the first active vibration member 310 (or the first vibration device 311) when the passive vibration member 350 vibrates, thereby preventing or blocking a horizontal vibration (or a biased vibration) of the first active vibration member 310 (or the first vibration device 311). For example, the balance member 390 may be referred to as a first mass portion, a first mass member, a first mass, or a first weight.

As described above, when the vibration apparatus 300 according to an embodiment of the present disclosure is driven (or vibrates), the vibration apparatus 300 may have a large vibration width (or displacement width) based on a composite vibration (or a synthetic vibration) of the first active vibration member 310 and the second active vibration member 330, and thus, a vibration width (or displacement width) of the passive vibration member 350 may increase, thereby increasing the strength (or wind power) and speed (or wind speed) of wind generated based on a vibration of the passive vibration member 350.

According to an embodiment of the present disclosure, when driving signals respectively applied to the first vibration device 311, the 2-1$^{st}$ vibration device 331, and the 2-2$^{nd}$ vibration device 332 have the same phase, a total vibration width (or displacement width) of the vibration apparatus 300 may be added to a vibration width (or displacement width) of the first vibration device 311 and a vibration width (or displacement width) of the 2-1$^{st}$ vibration device 331 (or the 2-2$^{nd}$ vibration device 332), and thus, may be maximized. Accordingly, the vibration apparatus 300 according to an embodiment of the present disclosure may increase (or amplify) or maximize a vibration width (or displacement width) of the passive vibration member 350 and may vibrate the passive vibration member 350 at a lowest vibration number (or lowest vibration frequency) of several Hz to tens Hz.

Accordingly, the vibration apparatus 300 according to an embodiment of the present disclosure may increase the strength (or wind power) and speed (or wind speed) of wind generated based on a vibration of the passive vibration member 350 and may generate wind (or air) with a noise sound inaudible to a user and may blow (or discharge) the wind (or the air) to the outside through the one or more blowing holes 101.

Figure 4:
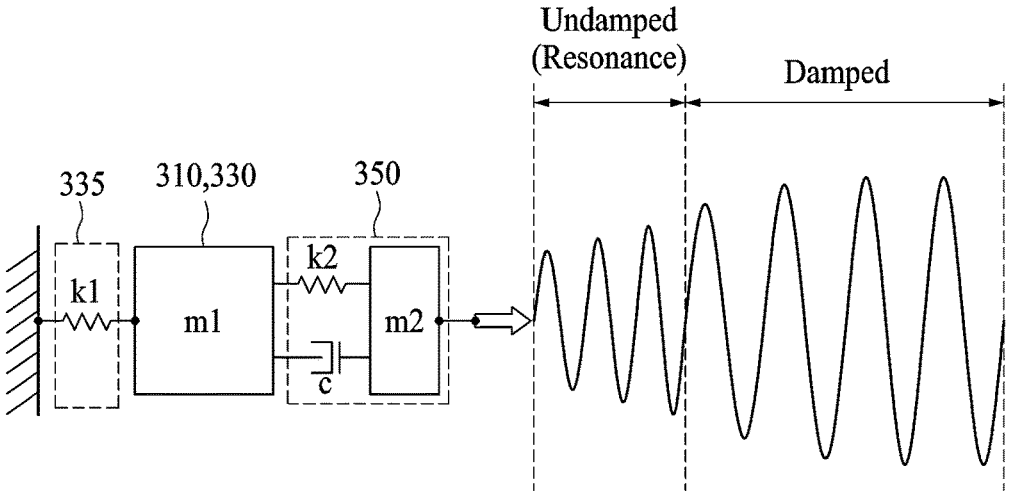
FIG. 4 illustrates a vibration model of an apparatus according to an embodiment of the present disclosure.

FIG. 4 illustrates a vibration model of an apparatus according to an embodiment of the present disclosure.

With reference to FIGS. 2 to 4, the apparatus according to an embodiment of the present disclosure may have the composite structure of the 2-degree-of-freedom vibration model. For example, the apparatus according to an embodiment of the present disclosure may include a composite model of one undamping model and one damping model.

In the apparatus according to an embodiment of the present disclosure, a second active vibration member 330 may be connected to a housing 100 by a coupling member 335, the first active vibration member 310 and a second active vibration member 330 may be connected to each other, and the first active vibration member 310 may be connected to a passive vibration member 350 by a second adhesive member 340. Accordingly, the coupling member 335 may be modeled with a first spring constant k1, and a first active vibration member 310 and a second active vibration member 330 may be modeled with a first mass m1. Also, the passive vibration member 350 may have a weight and an elastic force, and thus, may be modeled with a second spring constant k2, a damping coefficient c, and a second mass m2. Accordingly, the first active vibration member 310 and the second active vibration member 330 may be construed as an undamping vibration model, and the passive vibration member 350 may be construed as a damped vibration model.

A force generated based on a vibration of each of the first active vibration member 310 and the second active vibration member 330 may vibrate the passive vibration member 350. The second mass m2 of the passive vibration member 350 affected by the force generated based on a vibration of each of the first active vibration member 310 and the second active vibration member 330 may be reduced due to the second spring constant k2 and the damping coefficient c, and thus, an acceleration applied to each of the first active vibration member 310, the second active vibration member 330, and the passive vibration member 350 may increase based on the force generated based on a vibration of each of the first active vibration member 310 and the second active vibration member 330 and an acceleration applied to each of the first active vibration member 310 and the second active vibration member 330 may be more increased by the second spring constant k2 and the damping coefficient c. Therefore, the first active vibration member 310 and the second active vibration member 330 may resonate at a large displacement. Also, a displacement (or vibration or driving) of each of the first active vibration member 310 and the second active vibration member 330 may be gradually transferred through the second spring constant k2 and the damping coefficient c, and thus, the displacement (or vibration or driving) of each of the first active vibration member 310 and the second active vibration member 330 may not be prevented (or reduced) by the second mass m2 of the passive vibration member 350.

Accordingly, the apparatus according to an embodiment of the present disclosure may increase a displacement amount (or displacement width) of each of the first active vibration member 310, the second active vibration member 330, and the passive vibration member 350, thereby enhancing the strength (or wind power) and speed (or wind speed) of wind generated based on a vibration of the passive vibration member 350, and may generate wind (or air) with a noise sound inaudible to a user and may blow (or discharge) the wind (or the air) to the outside through the one or more blowing holes 101.

Figure 5:
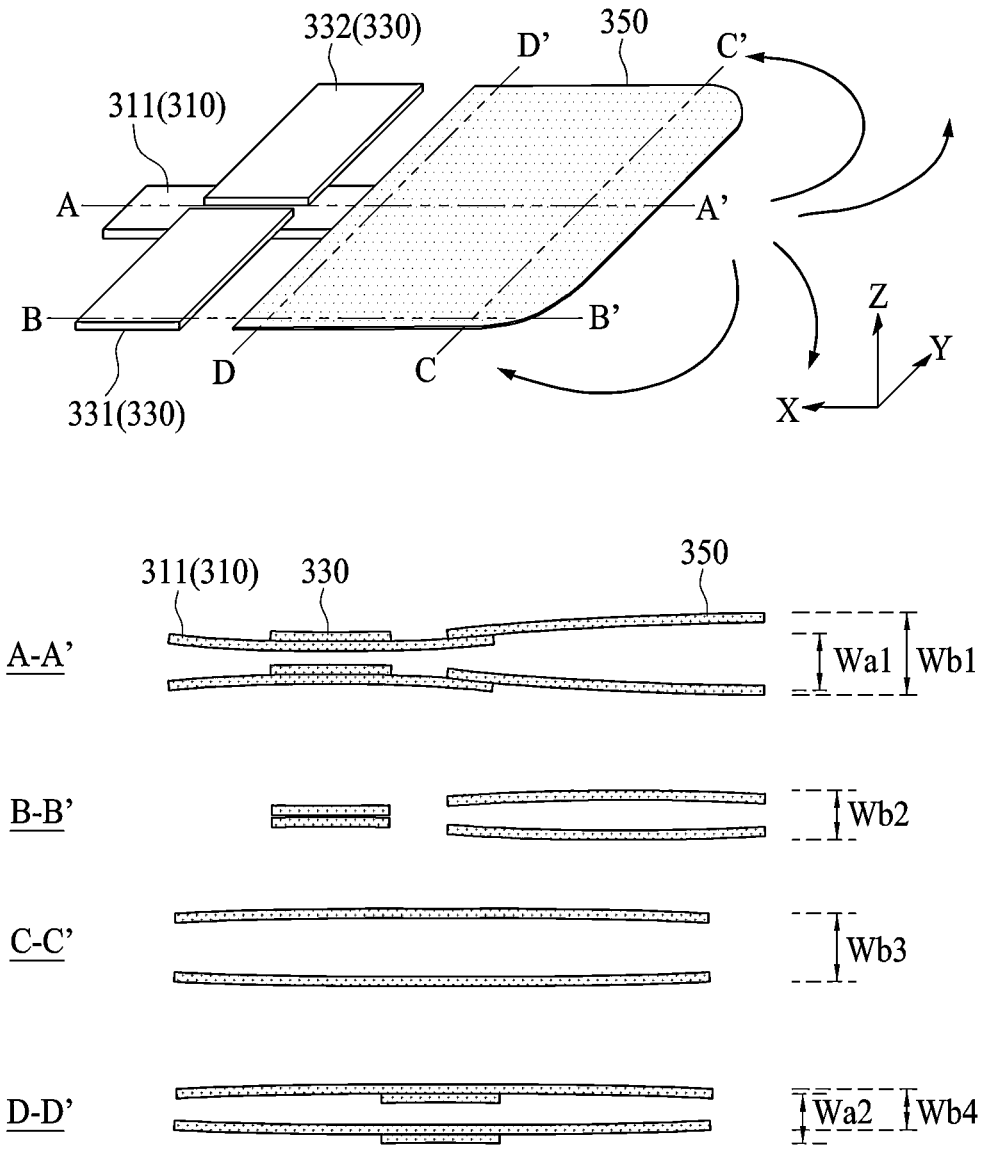
FIG. 5 illustrates a vibration width of each of the first active vibration member, the second active vibration member, and the passive vibration member illustrated in FIGS. 2 and 3.

FIG. 5 illustrates a vibration width (or displacement width) of each of the first active vibration member, the second active vibration member, and the passive vibration member illustrated in FIGS. 2 and 3.

With reference to FIG. 5, a driving signal (or a first driving signal) applied to the first vibration device 311 of the first active vibration member 310 may have the same phase as a driving signal (or a second driving signal) applied to each of the 2-1$^{st}$ vibration device 331 and the 2-2$^{nd}$ vibration device 332 of the second active vibration member 330. Therefore, each of the first vibration device 311, the 2-1$^{st}$ vibration device 331, and the 2-2$^{nd}$ vibration device 332 may be bend (or displaced or vibrated) in the same shape. Accordingly, a vibration width (or displacement width) of a second periphery portion of the first vibration device 311 may be maximized by adding a vibration width (or displacement width) of a first periphery portion of each of the 2-1$^{st}$ vibration device 331 and the 2-2$^{nd}$ vibration device 332. For example, a vibration generated by the first vibration device 311 and a vibration generated by each of the 2-1$^{st}$ vibration device 331 and the 2-2$^{nd}$ vibration device 332 may be reinforced, and thus, vibration efficiency may be enhanced and a vibration width (or displacement width) may be maximized.

The passive vibration member 350 may vibrate based on a vibration of the second periphery portion of the first vibration device 311 to generate wind.

As in line A-A' illustrated in FIG. 5, with respect to a lengthwise direction of the first vibration device 311, a first vibration (or a center vibration in the first direction) of a center portion of the passive vibration member 350 parallel to the first direction X may have a first vibration width (or displacement width) Wb1 which is greater than a first device vibration width (or displacement width) Wa1 of each of the first vibration device 311, the 2-1$^{st}$ vibration device 331, and the 2-2$^{nd}$ vibration device 332. For example, the first vibration width (or displacement width) Wb1 may correspond to a maximum vibration width (or displacement width) of the passive vibration member 350 based on a composite vibration of the first vibration device 311, the 2-1$^{st}$ vibration device 331, and the 2-2$^{nd}$ vibration device 332.

As in line B-B' illustrated in FIG. 5, with respect to the first direction X, a second vibration (or a periphery vibration in the first direction) of a first periphery portion of the passive vibration member 350 parallel to the center portion of the passive vibration member 350 may have a second vibration width (or displacement width) Wb2 which is smaller than a first vibration of the passive vibration member 350.

As in line C-C' illustrated in FIG. 5, a third vibration (or an outer vibration or an end vibration) of a first end portion (or a first side or a first periphery portion) of the passive vibration member 350 adjacent to the blowing hole of the housing may have a third vibration width (or displacement width) Wb3 which is smaller than a first vibration of the passive vibration member 350 and is greater than a second vibration of the passive vibration member 350.

As in line D-D' illustrated in FIG. 5, a fourth vibration (or an inner vibration) of a second end portion (or a second side or a second periphery portion) of the passive vibration member 350 including a connection portion with the first vibration device 311 in parallel with a first end portion of the passive vibration member 350 may have a fourth vibration width (or displacement width) Wb4 which is smaller than a second device vibration width (or displacement width) Wa2 of each of the first vibration device 311, the 2-1$^{st}$ vibration device 331, and the 2-2$^{nd}$ vibration device 332. For example, the fourth vibration width (or displacement width) Wb4 may correspond to a minimum vibration width (or displacement width) of the passive vibration member 350 based on a composite vibration of the first vibration device 311, the 2-1$^{st}$ vibration device 331, and the 2-2$^{nd}$ vibration device 332.

As described above, the passive vibration member 350 may generate wind based on portion-based vibration widths (or displacement width) Wb1 to Wb4 and may blow (or discharge) the wind to the outside through the blowing hole 101 of the housing. For example, as in line A-A' illustrated in FIG. 5, the passive vibration member 350 may generate relatively strong wind in the center portion of the passive vibration member 350 parallel to the first direction X and may generate relatively weak wind in a direction from the center portion of the passive vibration member 350 to the periphery portion thereof. Accordingly, the passive vibration member 350 may blow (or discharge) relatively more wind to the outside through the blowing hole 101 of the housing, based on a vibration of the center portion and the periphery portion parallel to the first direction X. For example, the passive vibration member 350 may generate scattered wind or fresh wind and may blow (or discharge) the wind to the outside through the one or more blowing holes 101.

Figure 6:
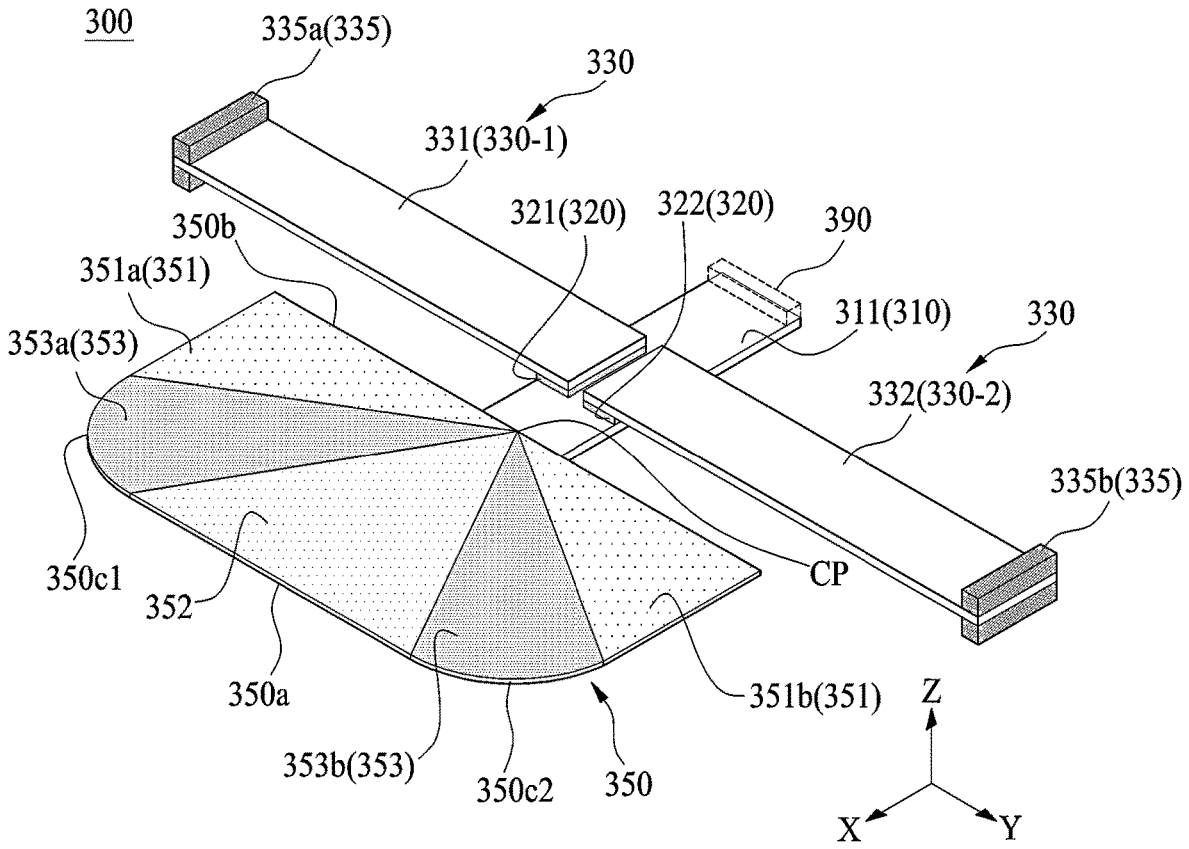
FIG. 6 is a perspective view illustrating the vibration apparatus according to another embodiment of the present disclosure.

FIG. 6 is a perspective view illustrating the vibration apparatus according to another embodiment of the present disclosure. FIG. 6 illustrates an embodiment implemented by modifying the passive vibration member in the vibration apparatus illustrated in FIGS. 1 to 3. Therefore, in descriptions of FIG. 6, the other elements except a passive vibration member and relevant elements are referred to by like reference numerals, and their repetitive descriptions may be omitted.

With reference to FIG. 6, in the vibration apparatus 300 according to an embodiment of the present disclosure, a passive vibration member 350 may include a plurality of regions (or vibration regions) 351, 352, and 353 having different hardnesses to each other. For example, the passive vibration member 350 may include first to third regions (or vibration regions) 351, 352, and 353 having different hardnesses to each other.

The first to third regions (or vibration regions) 351, 352, and 353 may be implemented in a radial shape (or a fan shape) with respect to a center point CP which is a connection portion connected to a first active vibration member 310. For example, the first to third regions (or vibration regions) 351 to 353 may have different sizes to each other.

The first region 351 may have a first hardness (or a first stiffness). The first region 351 may have half or less of a total area (or size) of the passive vibration member 350. For example, the first region 351 may be implemented in a triangular shape from a connection portion connected to the first active vibration member 310. For example, the first region 351 may include a second side (or a second long side or a second end portion) 350*b* of the passive vibration member 350 and both corner portions of the second side 350*b*.

The first region 351 may include 1-1$^{st}$ and 1-2$^{nd}$ regions 351*a* and 351*b*. For example, the 1-1$^{st}$ and 1-2$^{nd}$ regions 351*a* and 351*b* may be a pair of first regions 351. Each of the 1-1$^{st}$ and 1-2$^{nd}$ regions 351*a* and 351*b* may have a triangular shape or a rectangular shape. The 1-1$^{st}$ and 1-2$^{nd}$ regions 351*a* and 351*b* may be disposed adjacent to or in parallel with a second active vibration member 330. For example, the 1-1$^{st}$ region 351*a* may be disposed adjacent to a 2-1$^{nd}$ vibration device 331. For example, the 1-1$^{st}$ region 351*a* may be disposed adjacent to a 2-2$^{nd}$ vibration device 332. In the present disclosure, the 1-1$^{st}$ and 1-2$^{nd}$ regions 351*a* and 351*b* may be a first region and a second region, but embodiments of the present disclosure are not limited to digits "1-1$^{st}$" and "1-2$^{nd}$".

The second region 352 may have a second hardness (or a second stiffness) which is the same as or different from the first hardness of the first region 351. For example, the second region 352 may have the second hardness which is smaller than the first hardness of the first region 351. The second region 352 may have half or less of a total area (or size) of the passive vibration member 350. For example, an area (or size) occupied by the first region 351 and the second region 352 may be half or less of the total area (or size) of the passive vibration member 350. For example, an area (or size) of the second region 352 may be equal to or smaller than that of the first region 351.

The second region 352 may be implemented in a triangular shape from the connection portion connected to the first active vibration member 310. For example, the second region 352 may include a center portion and a first side (or a first long side or a first end portion) 350*a* of the passive vibration member 350. For example, the second region 352 may have a triangular shape or a regular triangular shape. For example, a vertex of the second region 352 having a triangular shape may be disposed at the connection portion connected to the first active vibration member 310. The second region 352 may be disposed between the 1-1$^{st}$ and 1-2$^{nd}$ regions 351*a* and 351*b* of the first region 351 and may be disposed at a center portion of the passive vibration member 350.

The third region 353 may have a third hardness which differs from each of the first hardness of the first region 351 and the second hardness of the second region 352. The third hardness of the third region 353 may be smaller than each of the first hardness of the first region 351 and the second hardness of the second region 352. The third region 353 may include a material which is softer than each of the first region 351 and the second region 352. The third region 353 may have the other area (or size), except a total area (or size) of the first region 351 and the second region 352, of the total area (or size) of the passive vibration member 350. For example, the third region 353 may be implemented in a triangular shape or a fan shape from the connection portion connected to the first active vibration member 310. For example, the third region 353 may include both corner portions 350*c*1 and 350*c*2 of the first side (or the first long side) 350*a* of the passive vibration member 350 or a curved portion of each of the both corner portions 350*c*1 and 350*c*2. For example, the third region 353 may be disposed between the first region 351 and the second region 352.

The third region 353 may include 3-1$^{th}$ and 3-2$^{th}$ regions 353*a* and 353*b*. For example, the 3-1$^{st}$ and 3-2$^{nd}$ regions 353*a* and 353*b* may be a pair of third regions 353. Each of the 3-1$^{st}$ and 3-2$^{nd}$ regions 353*a* and 353*b* may have a triangular shape or a fan shape. For example, the 3-1$^{st}$ region 353*a* may be disposed between the 1-1$^{st}$ region 351*a* of the first region 351 and the second region 352. For example, the 3-2$^{st}$ region 353*b* may be disposed between the 1-2$^{nd}$ region 351*b* of the first region 351 and the second region 352. In the present disclosure, the 3-1$^{st}$ and 3-2$^{nd}$ regions 353*a* and 353*b* may be a fourth region and a fifth region, but embodiments of the present disclosure are not limited to digits "3-1$^{st}$" and "3-2$^{nd}$.".

The first to third regions 351, 352, and 353 may be implemented in different materials. For example, the first to third regions 351, 352, and 353 may be implemented to have different materials to each other and/or different hardnesses to each other. The first to third regions 351, 352, and 353 may be connected to one another based on a junction structure of different materials or a connection structure of different materials.

As described above, according to another embodiment of the present disclosure, the passive vibration member 350 may include a hard region and a soft region, based on the first to third regions 351, 352, and 353. Therefore, the passive vibration member 350 may increase a vibration (or a displacement width) of the first side 350*a* or the end portion adjacent to the blowing hole of the housing, and thus, may generate wind which is reinforced more in linearity than the passive vibration member 350 descried above with reference to FIG. 5 and may allow a wind direction on a position apart therefrom by a certain distance (for example, 5 cm or more).

Therefore, an apparatus or a vibration apparatus 300 including the passive vibration member 350 according to another embodiment of the present disclosure may reinforce the linearity of wind generated based on a vibration of the passive vibration member 350, and thus, may allow a wind direction on a position apart therefrom by a certain distance (for example, 5 cm or more), thereby reinforcing a wind power and a wind speed.

Figure 7:
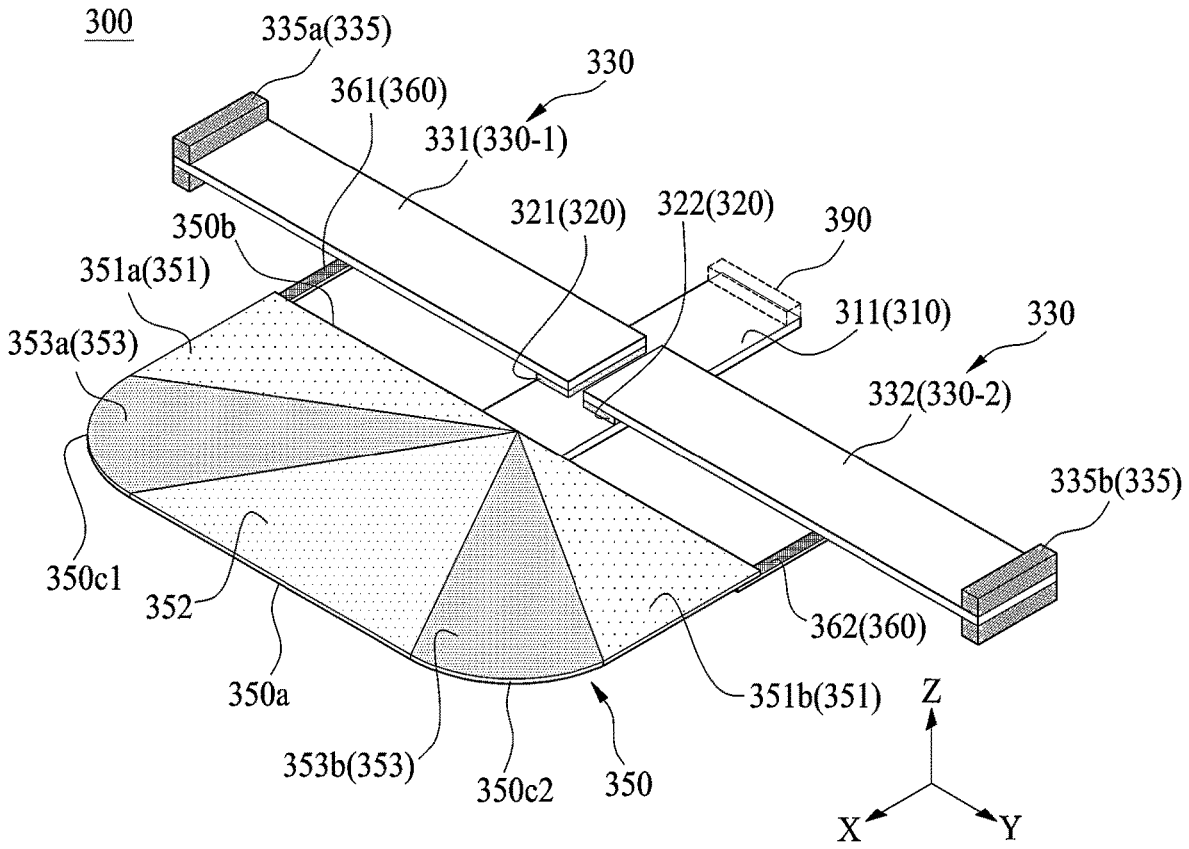
FIG. 7 is a perspective view illustrating the vibration apparatus according to another embodiment of the present disclosure.

FIG. 7 is a perspective view illustrating the vibration apparatus according to another embodiment of the present disclosure. FIG. 7 illustrates an embodiment where a connection member is additionally configured in the vibration apparatus illustrated in FIG. 6. The connection member illustrated in FIG. 7 may be equally applied to the vibration apparatus illustrated in FIG. 3. Therefore, in descriptions of FIG. 7, the other elements except a connection member and relevant elements are referred to by like reference numerals, and their repetitive descriptions may be omitted.

With reference to FIG. 7, a vibration apparatus 300 according to another embodiment of the present disclosure may further include a connection member 360.

The connection member 360 may be configured to be connected to a second active vibration member 330 and a passive vibration member 350. The connection member 360 may be connected between a second side 350*b* of the passive vibration member 350 and the second active vibration member 330. For example, the connection member 360 may be connected between both corner portions of the second side 350*b* of the passive vibration member 350 and the second active vibration member 330.

The connection member 360 according to an embodiment of the present disclosure may include a first connection member 361 and a second connection member 362.

The first connection member 361 according to an embodiment of the present disclosure may be connected between a first side (or a first portion) of the second side 350*b* of the passive vibration member 350 and a 2-1$^{st}$ active vibration member 330-1 of the second active vibration member 330. For example, the first connection member 361 may be connected between the first side of the second side 350*b* of the passive vibration member 350 and a 2-1$^{st}$ vibration device 331 of the second active vibration member 330. For example, the first connection member 361 may be connected between a first side corner portion of the second side 350*b* of the passive vibration member 350 and the 2-1$^{st}$ vibration device 331 of the second active vibration member 330. As an embodiment of the present disclosure, when the connection member 360 is applied to the vibration apparatus 300 illustrated in FIG. 3, a first periphery portion of the first connection member 361 may be connected to or attached on a first surface (or a front surface) or a second surface (or a rear surface) of the 2-1$^{st}$ vibration device 331, and a second periphery portion of the first connection member 361 may be connected to or attached on a first surface (or a front surface) or a second surface (or a rear surface) of the passive vibration member 350. As another embodiment of the present disclosure, when the connection member 360 is applied to the vibration apparatus 300 illustrated in FIG. 7, a first periphery portion of the first connection member 361 may be connected to or attached on a first surface (or a front surface) or a second surface (or a rear surface) of the 2-1$^{st}$ vibration device 331, and a second periphery portion of the first connection member 361 may be connected to or attached on a first surface (or a front surface) or a second surface (or a rear surface) of a 1-1$^{st}$ region 351*a* of the passive vibration member 350.

The second connection member 362 according to an embodiment of the present disclosure may be connected between a second side (or a second portion) of the second side 350*b* of the passive vibration member 350 and a 2-2$^{nd}$ active vibration member 330-2 of the second active vibration member 330. For example, the second connection member 362 may be connected between the second side of the second side 350*b* of the passive vibration member 350 and a 2-2$^{nd}$ vibration device 332 of the second active vibration member 330. For example, the second connection member 362 may be connected between a second side corner portion of the second side 350*b* of the passive vibration member 350 and the 2-2$^{nd}$ vibration device 332 of the second active vibration member 330. As an embodiment of the present disclosure, when the connection member 360 is applied to the vibration apparatus 300 illustrated in FIG. 3, a first periphery portion of the second connection member 362 may be connected to or attached on a first surface (or a front surface) or a second surface (or a rear surface) of the 2-2$^{nd}$ vibration device 332, and a second periphery portion of the second connection member 362 may be connected to or attached on a first surface (or a front surface) or a second surface (or a rear surface) of the passive vibration member 350. As another embodiment of the present disclosure, when the connection member 360 is applied to the vibration apparatus 300 illustrated in FIG. 7, a first periphery portion of the second connection member 362 may be connected to or attached on a first surface (or a front surface) or a second surface (or a rear surface) of the 2-2$^{nd}$ vibration device 332, and a second periphery portion of the second connection member 362 may be connected to or attached on a first surface (or a front surface) or a second surface (or a rear surface) of a 1-2$^{nd}$ region 351*b* of the passive vibration member 350.

The connection members 360, 361, and 362 may be configured as an adhesive material capable of compression and decompression. For example, the connection members 360, 361, and 362 may be configured as an elastic body having an elastic modulus (or Young's modulus) which is lower than each of a 2-1$^{st}$ vibration device 331 and a 2-2$^{nd}$ vibration device 332. The connection members 360, 361, and 362 may include an elastic pad such as a rubber pad or a silicone pad, or the like, which has adhesive properties and is capable of compression and decompression. For example, the connection members 360, 361, and 362 may include an acrylic-based adhesive material having a characteristic which is relatively good in adhesive force and high in hardness, but embodiments of the present disclosure are not limited thereto.

As described above, the connection members 360, 361, and 362 may prevent or minimize a vibration of the second side 350*b* of the passive vibration member 350, and thus, may prevent or minimize a wave phenomenon in the second side 350*b* of the passive vibration member 350 and the occurrence of noise caused thereby. Accordingly, an apparatus or a vibration apparatus 300 including the connection member 360 according to an embodiment of the present disclosure may prevent or minimize the wave phenomenon in the second side 350*b* of the passive vibration member 350 and the occurrence of noise caused thereby.

Figure 8:
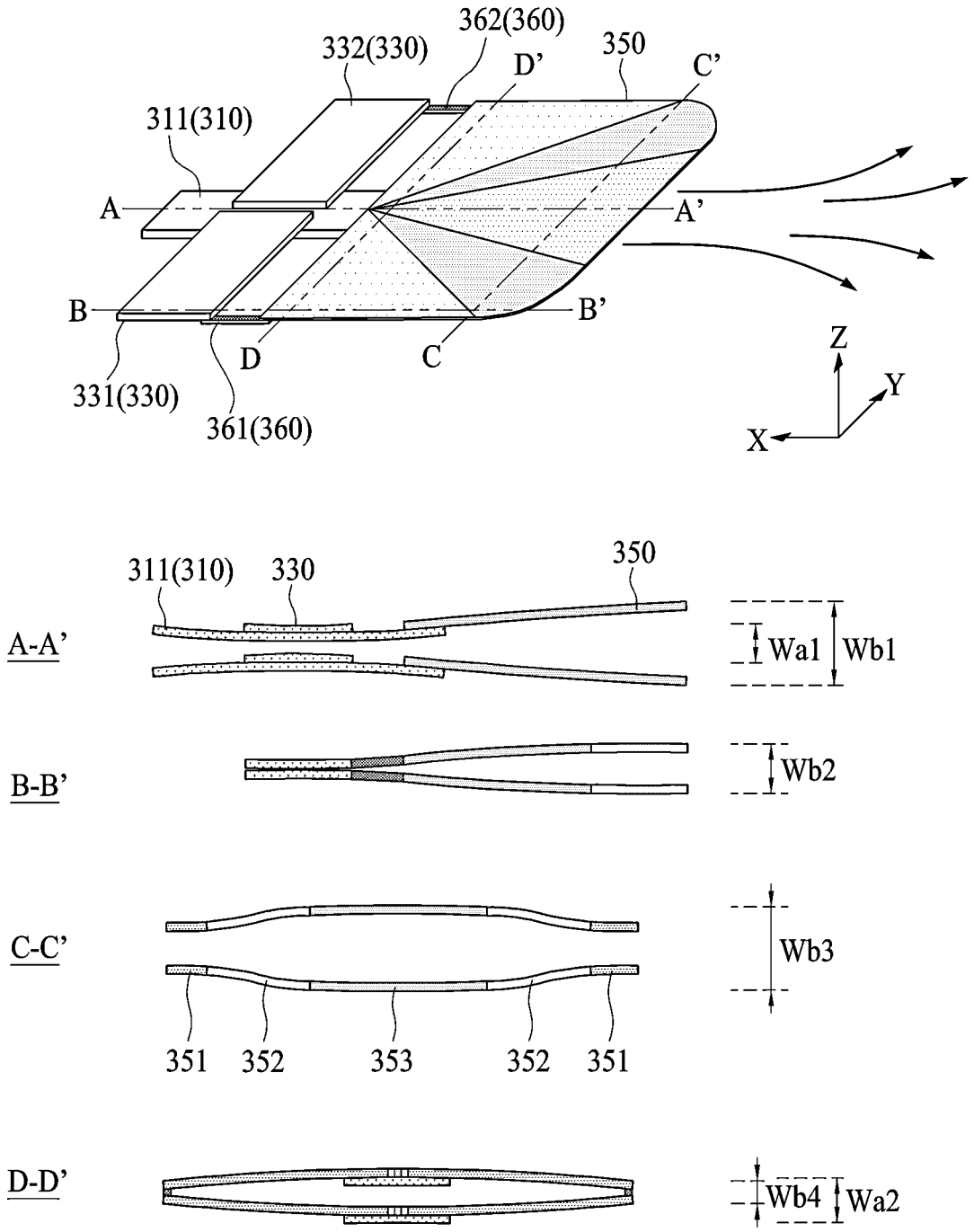
FIG. 8 illustrates a vibration width (or displacement width) of each of the first active vibration member, the second active vibration member, and the passive vibration member illustrated in FIG. 7.

FIG. 8 illustrates a vibration width (or displacement width) of each of the first active vibration member, the second active vibration member, and the passive vibration member illustrated in FIG. 7.

With reference to FIG. 8, a driving signal (or a first driving signal) applied to the first vibration device 311 of the first active vibration member 310 may have the same phase as a driving signal (or a second driving signal) applied to each of the 2-1$^{st}$ vibration device 331 and the 2-2$^{nd}$ vibration device 332 of the second active vibration member 330. Therefore, each of the first vibration device 311, the 2-1$^{st}$ vibration device 331, and the 2-2$^{nd}$ vibration device 332 may be bend (or displaced or vibrated) in the same shape. Accordingly, a vibration width (or displacement width) of a second periphery portion of the first vibration device 311 may be maximized by adding a vibration width (or displacement width) of a first periphery portion of each of the 2-1$^{st}$ vibration device 331 and the 2-2$^{nd}$ vibration device 332. For example, a vibration generated by the first vibration device 311 and a vibration generated by each of the 2-1$^{st}$ vibration device 331 and the 2-2$^{nd}$ vibration device 332 may be reinforced, and thus, vibration efficiency may be enhanced and a vibration width (or displacement width) may be maximized.

The passive vibration member 350 may vibrate based on a vibration of the second periphery portion of the first vibration device 311 to generate wind.

Comparing with a portion-based vibration width (or displacement width) of the passive vibration member 350 illustrated in FIG. 5, in a portion-based vibration width (or displacement width) of the passive vibration member 350 illustrated in FIG. 8, the passive vibration member 350 illustrated in FIG. 8 may increase each of a first vibration width Wb1, a second vibration width Wb2, and a third vibration width Wb3 associated with the linearity, wind speed, and wind amount of wind and may decrease a fourth vibration width Wb4 associated with the wave phenomenon.

Therefore, because the passive vibration member 350 includes a hard region and a soft region, based on the first to third regions 351, 352, and 353, a vibration (or a displacement width) of the first side 350*a* or the end portion adjacent to the blowing hole of the housing may increase, and thus, wind having reinforced linearity may be generated, a wind speed and a wind amount may increase, and a wind direction may concentrate. Also, in the passive vibration member 350, the second side 350*b* or the end portion may be connected to the second active vibration member 330 by the connection member 360, and thus, a vibration (or displacement width) of each of the first and second periphery portions may decrease, thereby preventing or minimizing the wave phenomenon and the occurrence of noise caused thereby.

Figure 9:
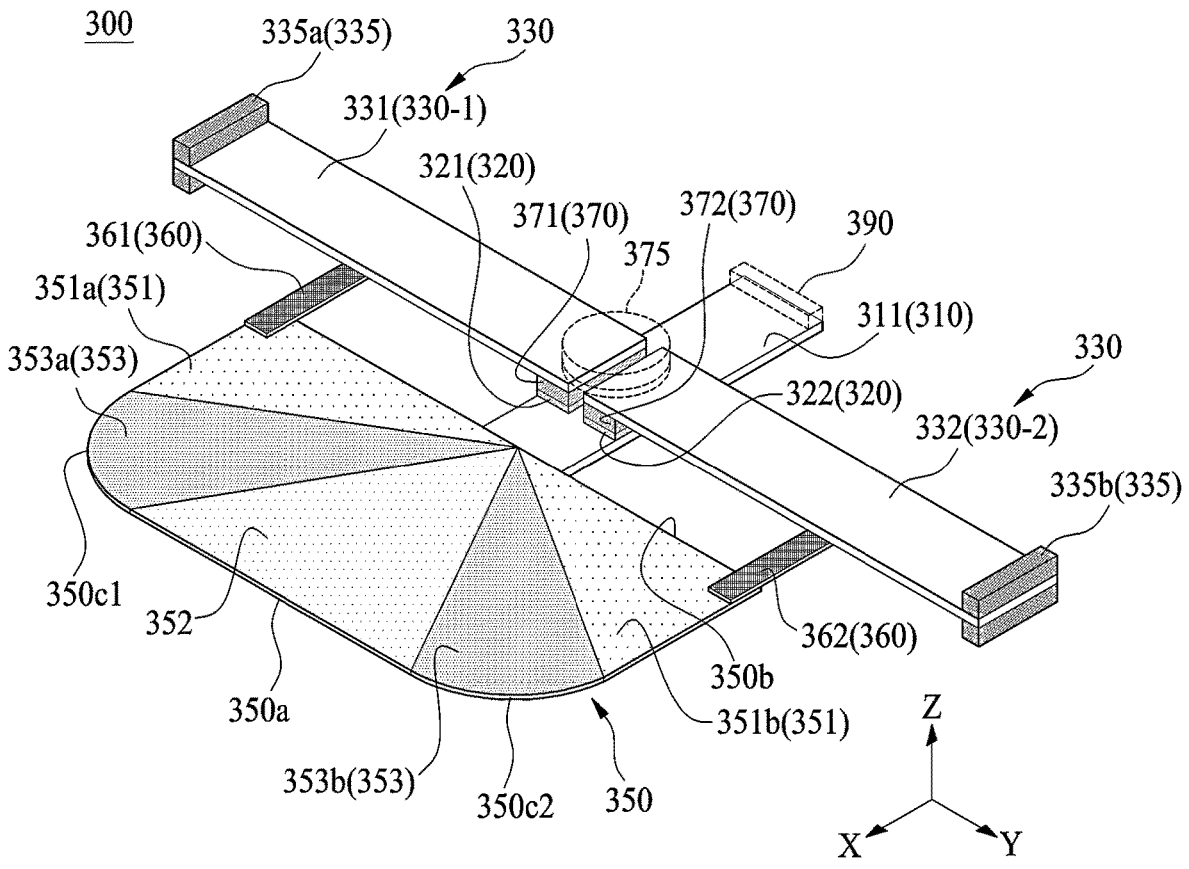
FIG. 9 is a perspective view illustrating the vibration apparatus according to another embodiment of the present disclosure.

FIG. 9 is a perspective view illustrating the vibration apparatus according to another embodiment of the present disclosure. FIG. 9 illustrates an embodiment implemented where a mass member is additionally configured in the vibration apparatus illustrated in FIG. 7. Therefore, in descriptions of FIG. 9, the other elements except a mass member and relevant elements are referred to by like reference numerals, and their repetitive descriptions may be omitted.

With reference to FIG. 9, an apparatus or a vibration apparatus 300 according to an embodiment of the present disclosure may further include a mass member 370.

The mass member 370 may be disposed between a plurality of active vibration members 310 and 330. For example, the mass member 370 may be disposed at an intersection portion between a plurality of active vibration members 310 and 330. For example, the mass member 370 may be disposed between a first active vibration member 310 and a second active vibration member 330. For example, the mass member 370 may be disposed at an intersection portion between the first active vibration member 310 and the second active vibration member 330. For example, the mass member 370 may be disposed between each of a 2-1$^{st}$ active vibration member 330-1 and a 2-2$^{nd}$ active vibration member 330-2 and the first active vibration member 310. For example, the mass member 370 may be disposed between a first adhesive member 320 and the first active vibration member 310 or between the first adhesive member 320 and the second active vibration member 330. For example, the mass member 370 may be disposed between each of the 2-1$^{st}$ active vibration member 330-1 and the 2-2$^{nd}$ active vibration member 330-2 and the first adhesive member 320.

The mass member 370 may be disposed between a first vibration device 311 and each of a 2-1$^{st}$ vibration device 331 and a 2-2$^{nd}$ vibration device 332. For example, the mass member 370 may be disposed between a first vibration device 311 and the first adhesive member 320. For example, the mass member 370 may be disposed between each of the 2-1$^{st}$ vibration device 331 and the 2-2$^{nd}$ vibration device 332 and the first adhesive member 320. The mass member 370 may be embedded in the first adhesive member 320. The first adhesive member 320 may be disposed to wholly surround the mass member 370.

The mass member 370 may include a 1-1$^{st}$ mass member 371 and a 1-2$^{nd}$ mass member 372. For example, the mass member 370 may be a mass portion, a mass, or a weight. For example, the 1-1$^{st}$ mass member 371 and the 1-2$^{nd}$ mass member 372 may be a pair of first mass portions, a pair of mass members, a pair of masses, or a pair of weights. In the present disclosure, the 1-1$^{st}$ mass member 371 and the 1-2$^{nd}$ mass member 372 may be a first mass member and a second mass member, but embodiments of the present disclosure are not limited to digits "1-1$^{st}$" and "1-2$^{nd}$".

According to an embodiment of the present disclosure, each of the 1-1$^{st}$ mass member (or a 1-1$^{st}$ mass portion) 371 and the 1-2$^{nd}$ mass member (or a 1-2$^{nd}$ mass portion) 372 may include a first surface and a second surface.

The first surface of the 1-1$^{st}$ mass member 371 may be connected (or adhered) to a 1-1$^{st}$ adhesive member 321. The first surface of the 1-2$^{nd}$ mass member 372 may be connected (or adhered) to a 1-2$^{nd}$ adhesive member 322. The second surface of the 1-1$^{st}$ mass member 371 may be connected (or adhered) to the first vibration device 311 or a first periphery portion of the 2-1$^{st}$ vibration device 331. The second surface of the 1-2$^{nd}$ mass member 372 may be connected (or adhered) to the first vibration device 311 or a first periphery portion of the 2-2$^{nd}$ vibration device 332.

According to another embodiment of the present disclosure, the mass member 370 may not be divided into the 1-1$^{st}$ mass member 371 and the 1-2$^{nd}$ mass member 372 and may be configured as one body. For example, the mass member 370 may have a polygonal pillar shape or a circular pillar shape having a size which is smaller than or equal to a center portion of the first vibration device 311. For example, a first surface of the mass member 370 may be connected (or adhered) to the first adhesive member 320. A second surface of the mass member 370 may be connected (or adhered) to the center portion of the first vibration device 311, or may be commonly connected (or adhered) to a first periphery portion of each of the 2-1$^{st}$ vibration device 331 and the 2-2$^{nd}$ vibration device 332.

The mass member 370 or the 1-1$^{st}$ mass member 371 and the 1-2$^{nd}$ mass member 372 may include an elastic material capable of acting as a mass (or mass body) on the vibration devices 311, 331, and 332. For example, the mass member 370 or the 1-1$^{st}$ mass member 371 and the 1-2$^{nd}$ mass member 372 may include an elastic material having strength which is smaller than a bending strength of each of the vibration devices 311, 331, and 332. For example, the mass member 370 or the 1-1$^{st}$ mass member 371 and the 1-2$^{nd}$ mass member 372 may include the same elastic material as a coupling member 335 or a connection member 360, but embodiments of the present disclosure are not limited thereto. For example, the mass member 370 or the 1-1$^{st}$ mass member 371 and the 1-2$^{nd}$ mass member 372 may be formed by elastomer, but embodiments of the present disclosure are not limited thereto.

According to another embodiment of the present disclosure, the mass member 370 or the 1-1$^{st}$ mass member 371 and the 1-2$^{nd}$ mass member 372 may include an adhesive layer, or may not include the adhesive layer. For example, when the mass member 370 or the 1-1$^{st}$ mass member 371 and the 1-2$^{nd}$ mass member 372 do not include the adhesive layer, the vibration apparatus 300 according to another embodiment of the present disclosure may further include an adhesive member which is attached on a first surface of the mass member 370.

The mass member 370 or the 1-1$^{st}$ mass member 371 and the 1-2$^{nd}$ mass member 372 may act as a mass (or mass body) which increases a mass (or weight) of each of the first vibration device 311 and the 2-1$^{st}$ and 2-2$^{nd}$ vibration devices 331 and 332 to decrease a lowest resonance frequency (or lowest natural frequency) of each of the vibration devices 311, 331, and 332. Accordingly, each of the first vibration device 311 and the 2-1$^{st}$ and 2-2$^{nd}$ vibration devices 331 and 332 may more decrease a lowest resonance frequency (or lowest natural frequency), and thus, may vibrate at a relatively lower frequency.

Therefore, the passive vibration member 350 may have a large vibration width (or displacement width) based on a composite vibration (or a synthetic vibration) of the first active vibration member 310 and the second active vibration member 330. Accordingly, the passive vibration member 350 may vibrate with a greater displacement based on a greater displacement (or vibration) of the first active vibration member 310, and thus, may blow stronger and more wind (or air) to the outside through the blowing hole 101 of the housing 100. Also, the passive vibration member 350 may blow (or discharge) wind (or air) without noise, based on a vibration of an ultra-low-pitched sound band. For example, the passive vibration member 350 may vibrate at a vibration frequency corresponding to a frequency of an ultra-low-pitched sound band inaudible to a user. For example, the passive vibration member 350 may vibrate at a vibration frequency corresponding to a frequency of an ultra-low-pitched sound band of 100 Hz or less. For example, the passive vibration member 350 may vibrate at a lowest vibration number (or a lowest vibration frequency) of several Hz to tens Hz, and thus, may vibrate with a noise sound inaudible to a user to generate wind (or air).

The vibration apparatus 300 according to another embodiment of the present disclosure, as illustrated in FIG. 9, may further include a secondary mass member 375 for increasing a mass (or weight) of each of the first vibration device 311 and the 2-1$^{st}$ and 2-2$^{nd}$ vibration devices 331 and 332.

The secondary mass member 375 may be connected to first and second active vibration members 310 and 330, but embodiments of the present disclosure are not limited thereto. For example, the secondary mass member 375 may be connected to a rear center portion of the first vibration device 311. The secondary mass member 375 may include an elastic material which is the same as the mass member 370. For example, the secondary mass member 375 may be configured to have a polygonal pillar shape or a circular pillar shape having a size which is smaller than or equal to a center portion of the first vibration device 311. Accordingly, the apparatus or the vibration apparatus 300 according to another embodiment of the present disclosure may further include at least one of the mass member 370 and the secondary mass member 375, and thus, may have a larger vibration width (or displacement width) based on a composite vibration (or combined vibration) of the first active vibration member 310 and the second active vibration member 330. Therefore, the passive vibration member 350 may have a large vibration width (or displacement width) based on a composite vibration (or a synthetic vibration) of the first active vibration member 310 and the second active vibration member 330. Accordingly, the passive vibration member 350 may vibrate with a greater displacement based on a greater displacement (or vibration or driving) of the first active vibration member 310, and thus, may blow stronger and more wind (or air) to the outside through the blowing hole 101 of the housing 100.

At least one of the mass member 370 and the secondary mass member 375 illustrated in FIG. 9 may be identically applied to the vibration apparatus illustrated in FIGS. 3 and 6, and thus, their repetitive descriptions may be omitted.

Figure 10:
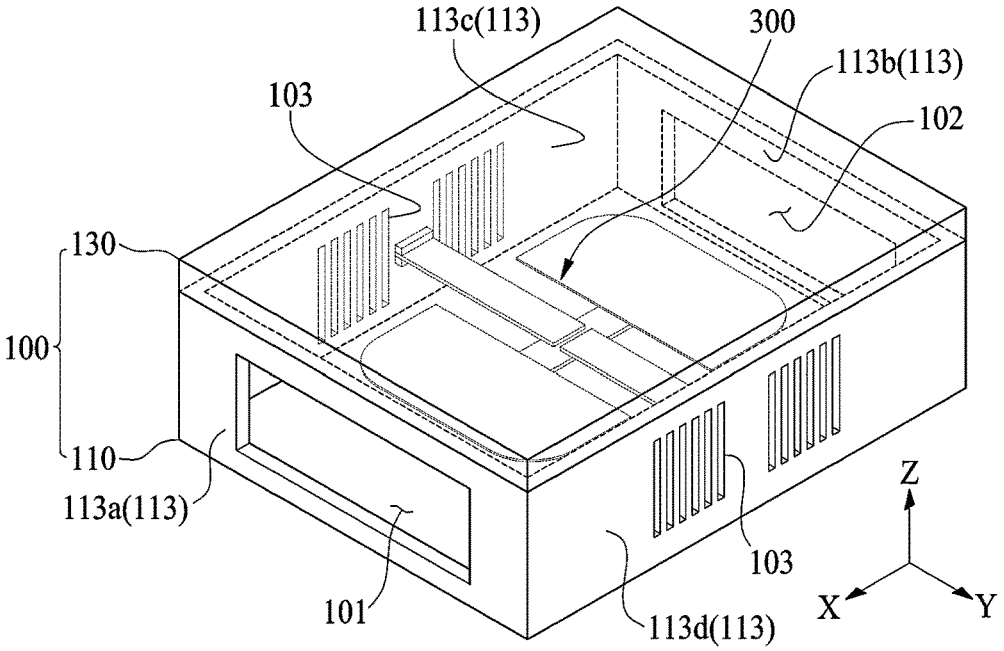
FIG. 10 illustrates an apparatus according to another embodiment of the present disclosure.
Figure 11:
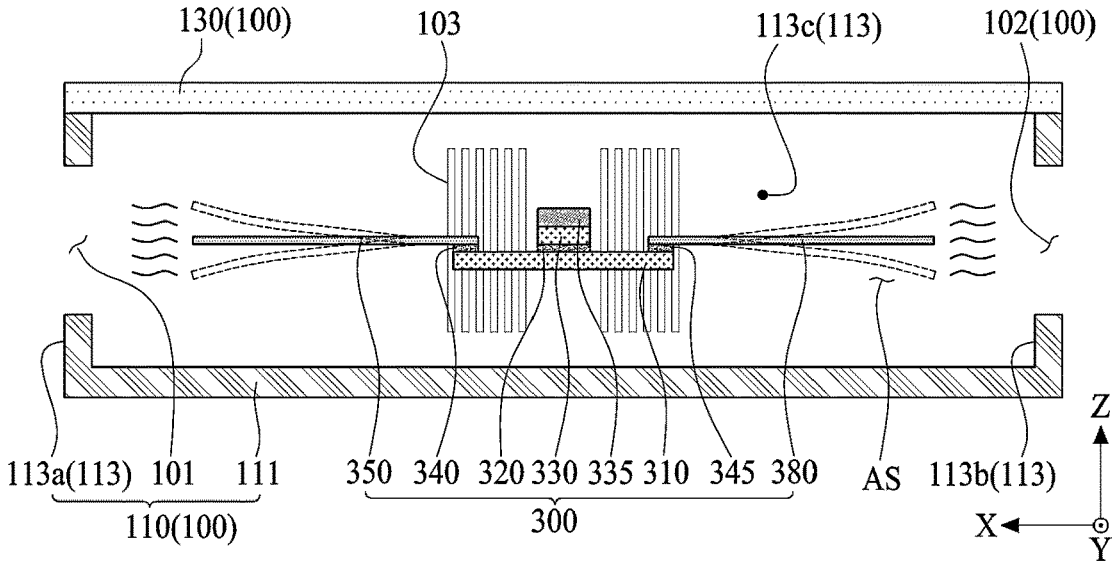
FIG. 11 is a cross-sectional view of the apparatus illustrated in FIG. 10.
Figure 12:
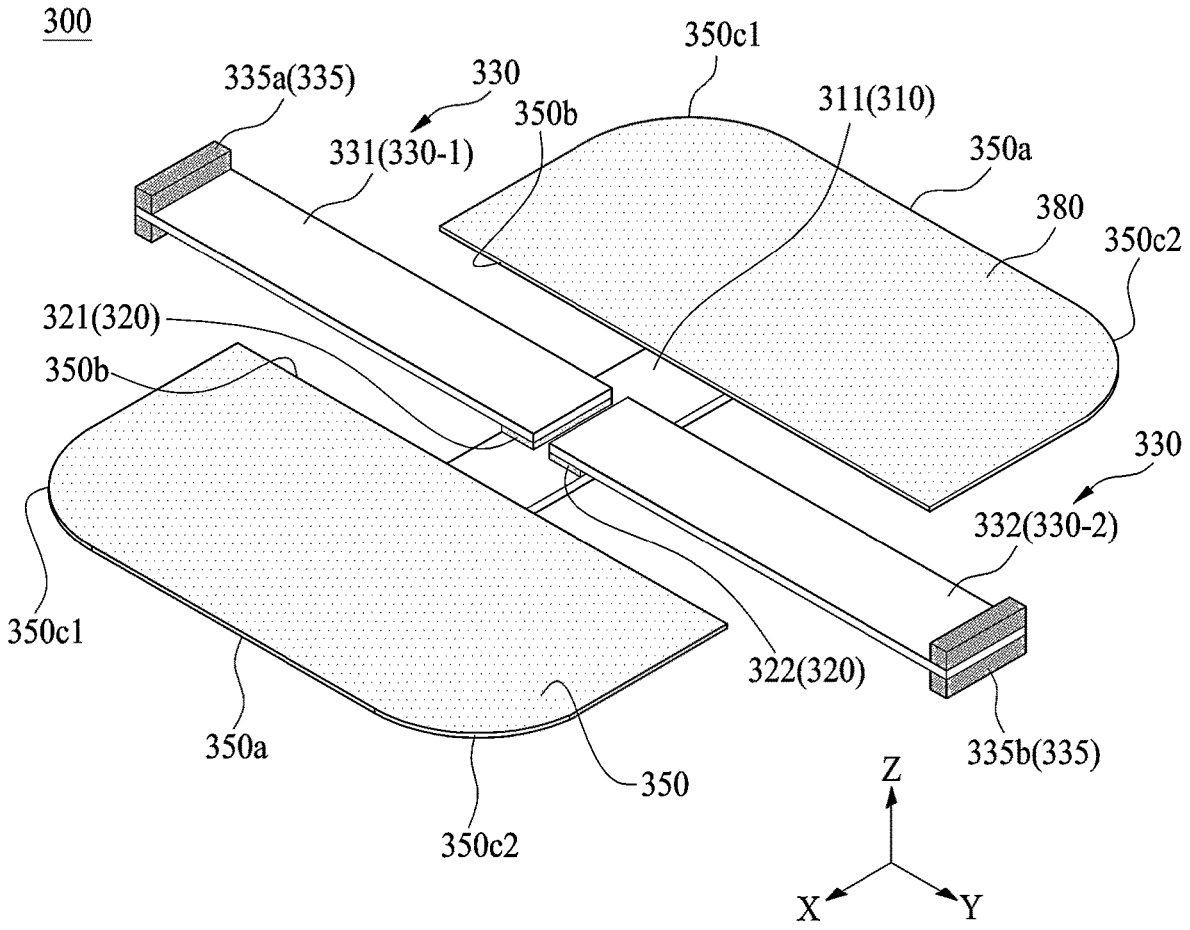
FIG. 12 is a perspective view illustrating the vibration apparatus according to another embodiment of the present disclosure illustrated in FIGS. 10 and 11.

FIG. 10 illustrates an apparatus according to another embodiment of the present disclosure. FIG. 11 is a cross-sectional view of the apparatus illustrated in FIG. 10. FIG. 12 is a perspective view illustrating the vibration apparatus according to another embodiment of the present disclosure illustrated in FIGS. 10 and 11. FIGS. 10 to 12 illustrate an embodiment where a second passive vibration member is additionally configured in the vibration apparatus of the apparatus illustrated in FIGS. 1 to 9. Therefore, in descriptions of FIGS. 10 to 12, the other elements except a second passive vibration member and relevant elements are referred to by like reference numerals, and their repetitive descriptions omitted.

With reference to FIGS. 10 to 12, an apparatus according to another embodiment of the present disclosure may include a housing 100 and a vibration apparatus 300.

Except for that the housing 100 further includes one or more second blowing holes 102, the housing 100 may be substantially the same as the housing 100 described above with reference to FIGS. 1 and 2, and thus, only the second blowing hole 102 will be described below.

The one or more second blowing holes 102 may be disposed at a lateral portion, which is parallel to a lateral portion where one or more blowing holes (or first blowing holes) 101 are disposed, of a plurality of lateral portions implementing a lateral portion of the housing 100. For example, the one or more second blowing holes 102 may be implemented to pass through a second lateral portion (or a second lateral portion 113*b*) of first to fourth lateral portions of the housing 100. For example, the one or more second blowing holes 102 may be implemented to pass through the second lateral portion of the housing 100 along a first direction X and extend long along a second direction Y. For example, the one or more second blowing holes 102 may include one or more slots or slits. Optionally, an air filter may be disposed at the one or more second blowing holes 102. In the following description, the one or more blowing holes 101 may be referred to as a first blowing hole, and the one or more second blowing holes 102 may be referred to as a second blowing hole.

The vibration apparatus 300 may be disposed in an accommodating space AS of the housing 100 and may be implemented to vibrate (or displace or drive) based on a driving signal input thereto to blow (or discharge) wind (or air) through the first blow hole 101 and the second blowing hole 102 in both directions. For example, the vibration apparatus 300 may be connected between inner surfaces of a third lateral portion (or a third sidewall portion) 113*c* and a fourth lateral portion (or a fourth sidewall portion) 113*d* of the housing 100 to face the first blow hole 101 and the second blowing hole 102.

The vibration apparatus 300 according to an embodiment of the present disclosure may include first and second active vibration members 310 and 330 connected to each other to intersect, a passive vibration member 350 connected to a first periphery portion of the first active vibration member 310, and a second passive vibration member 380 connected to a second periphery portion of the first active vibration member 310. The vibration apparatus 300 may be implemented by adding the second passive vibration member 380 to the vibration apparatus 300 illustrated in FIGS. 1 to 9. In the following description, therefore, the other elements except the second passive vibration member 380 and relevant elements are referred to by like reference numerals, and their repetitive descriptions may be omitted. In the following description, the passive vibration member 350 described above with reference to FIGS. 1 to 9 may be referred to as a first passive vibration member.

The second passive vibration member 380 may be connected to a second periphery portion of the first active vibration member 310 and may be disposed between the second blowing hole 102 of the housing 100 and the first active vibration member 310. The second passive vibration member 380 may vibrate based on a displacement (or vibration or driving) of the first active vibration member 310, and thus, may generate wind. For example, the second passive vibration member 380 may vibrate based on the displacement (or vibration or driving) of the first active vibration member 310 to blow wind (or air) to the outside through the second blowing hole 102 of the housing 100. For example, the second passive vibration member 380 may be a second wind generating member, a second blowing member, a second wing member, a second blowing wing, a second vibration plate, a second wind generating plate, a second blowing plate, or a second fan, but embodiments of the present disclosure are not limited thereto. As described above, except for that the balance member 390 described above with reference to FIGS. 1 to 9 are omitted and the second passive vibration member 380 is connected to the second periphery portion of the first active vibration member 310, the second passive vibration member 380 may be substantially the same as the first passive vibration member 350, and thus, the repetitive description thereof may be omitted.

The vibration apparatus 300 according to another embodiment of the present disclosure may further include a third adhesive members 345.

The third adhesive members 345 may be disposed between the first active vibration member 310 and the second passive vibration member 380. For example, the third adhesive members 345 may be disposed between a second periphery portion of the first active vibration member 310 and the second passive vibration member 380. The third adhesive members 345 may be disposed between the first vibration device 311 and the second passive vibration member 380. For example, the third adhesive members 345 may be disposed between a second periphery portion of the first vibration device 311 and the second passive vibration member 380.

The third adhesive members 345 according to an embodiment of the present disclosure may be configured as an adhesive material capable of compression and decompression. For example, the third adhesive members 345 may be configured as adhesive material which is substantially the same as the second adhesive member 340.

As described above, the vibration apparatus 300 according to another embodiment of the present disclosure may blow (or discharge) the wind (or air) generated based on a vibration of the first and second passive vibration members 350 and 380 to the outside through the first and second blowing holes 101 and 102 in both directions, and may generate wind (or air) with a noise sound inaudible to a user and may blow (or discharge) the wind (or the air) to the outside through the first and second blowing holes 101 and 102 in both directions.

In an apparatus according to another embodiment of the present disclosure, each of the first and second passive vibration members 350 and 380 of the vibration apparatus illustrated in FIGS. 10 to 12 may be configured identical to the passive vibration member 350 described above with reference to FIG. 6, and thus, the linearity of wind generated based on a vibration of each of the first and second passive vibration members 350 and 380 may be reinforced. For example, in the first passive vibration member 350, a plurality of regions 351 to 353 may be implemented in a radial shape with respect to a connection portion between the first active vibration member 310 and the first passive vibration member 350. For example, in the second passive vibration member 380, the plurality of regions 351 to 353 may be implemented in a radial shape with respect to a connection portion between the first active vibration member 310 and the second passive vibration member 380.

In an apparatus according to another embodiment of the present disclosure, each of the first and second passive vibration members 350 and 380 of the vibration apparatus illustrated in FIGS. 10 to 12 may be configured to be connected to the second active vibration member 330 through the connection member 360 described above with reference to FIG. 7, and thus, the wave phenomenon occurring in the second side 350*b* of each of the first and second passive vibration members 350 and 380 and the occurrence of noise caused thereby may be prevented or minimized. For example, the connection member 360 may include a 1-1$^{st}$ connection member 361 connected between a 2-1$^{st}$ vibration member 330-1 of the second active vibration member 330 and the first passive vibration member 350, a 1-2$^{st}$ connection member connected between the 2-1$^{st}$ vibration member 330-1 of the second active vibration member 330 and the second passive vibration member 380, a 2-1$^{st}$ connection member 362 connected between a 2-2$^{nd}$ vibration member 330-2 of the second active vibration member 330 and the first passive vibration member 350, and a 2-2$^{nd}$ connection member connected between the 2-2$^{nd}$ vibration member 330-2 of the second active vibration member 330 and the second passive vibration member 380.

In an apparatus according to another embodiment of the present disclosure, the vibration apparatus 300 illustrated in FIGS. 10 to 12 may be configured to further include at least one of the mass member 370 and the secondary mass member 375 illustrated in FIG. 9, and thus, the vibration apparatus 300 may vibrate at a vibration frequency corresponding to a frequency of an ultra-low-pitched sound band inaudible to a user and each of the first and second passive vibration members 350 and 380 may blow stronger and more wind (or air) to the outside through the first and second blowing holes 101 and 102 of the housing 100.

A blowing apparatus according to embodiments of the present disclosure will be described below.

A blowing apparatus according to one or more example embodiments of the present disclosure may comprise a housing including an accommodating space and one or more blowing holes, and a vibration apparatus in the accommodating space, wherein the vibration apparatus comprises a first active vibration member, a second active vibration member connected to an inner lateral surface of the housing and connected to intersect with the first active vibration member, and a passive vibration member between the one or more blowing holes and the first active vibration member and connected to the first active vibration member.

According to one or more example embodiments of the present disclosure, the blowing apparatus may further comprise a balance member disposed at the first active vibration member, the passive vibration member may be disposed at a first periphery portion of the first active vibration member adjacent to the one or more blowing holes, and the balance member may be disposed at a second periphery portion parallel to the first periphery portion of the first active vibration member.

According to one or more example embodiments of the present disclosure, the blowing apparatus may further comprise a connection member between the passive vibration member and the second active vibration member.

According to one or more example embodiments of the present disclosure, the passive vibration member may comprise a first end portion adjacent to the one or more blowing holes, and a second end portion at a periphery portion of the first active vibration member, and a corner portion of the first end portion may have a curved shape. The passive vibration member may comprise a first end portion (or first edge or first periphery) adjacent to the one or more blowing holes, and a second end portion (or second edge or second periphery) at a periphery portion of the first active vibration member. For example, the passive vibration member may comprise a first end portion facing the blowing hole and a second end portion opposite to the first end portion and extending parallel to the first end portion. The passive vibration member may have a substantially rectangular shape. At least one corner portion of the first end portion may have a curved shape and/or be rounded (i.e. in a plane perpendicular to the sidewall of the housing to which the second active vibration member is mounted).

According to one or more example embodiments of the present disclosure, the passive vibration member may comprise a plurality of regions having different hardnesses and/or including (or being formed of) different materials.

According to one or more example embodiments of the present disclosure, the plurality of regions may be implemented in a radial shape with respect to a connection portion between the first active vibration member and the passive vibration member. For example, the plurality of regions may extend from the connection portion to an edge of the passive vibration member and/or may be arranged in circumferential direction around the connection portion. Thus, the regions may have a shape of a sector, respectively.

According to one or more example embodiments of the present disclosure, a first region of the plurality of regions may comprise the second end portion and has a first hardness, a second region of the plurality of regions may comprise the first end portion and has a second hardness which is smaller than the first hardness, and a third region between the first region and the second region may comprise a corner portion of the first end portion and has a third hardness which is smaller than each of the first hardness and the second hardness. For example, the passive vibration member may be divided into a plurality of regions, the plurality of regions may include: a first region of which one edge is formed by the first end portion of the passive vibration member facing the blowing hole; at least one second region (e.g. two second regions) of which one edge is formed by the second end portion of the passive vibration member being opposite to the first end portion; and at least one third region (e.g. two third regions) disposed between the first and second region and of which one edge is (respectively) formed by a corner portion of the passive vibration member that faces the blowing hole. The first region may be the hardest. The third region may be the softest. For example, the first hardness may be higher than the second hardness and third hardness. The two second regions may extend from the connection portion to an outer edge of the passive vibration member and/or respectively comprise half of the second end portion of the passive vibration member. The passive vibration member and/or the plurality of regions may be symmetrical with respect to a line being perpendicular to the second end portion and crossing the connection portion.

According to one or more example embodiments, the blowing hole may include a first blowing hole and a second blowing hole. The first blowing hole and the second blowing hole may be disposed facing each other and/or in opposite sidewalls of the housing. The blowing holes may include one or more first and second blowing holes parallel to one another. The passive vibration member may include a first passive vibration member between the one or more first blowing holes and the first active vibration member and connected to the first active vibration member, and/or a second passive vibration member between the one or more second blowing holes and the first active vibration member and connected to the first active vibration member.

A blowing apparatus according to one or more example embodiments of the present disclosure may comprise a housing including an accommodating space and one or more first and second blowing holes parallel to one another, and a vibration apparatus in the accommodating space, the vibration apparatus may comprise a first active vibration member, a second active vibration member connected to an inner lateral surface of the housing and connected to intersect with the first active vibration member, a first passive vibration member between the one or more first blowing holes and the first active vibration member and connected to the first active vibration member, and a second passive vibration member between the one or more second blowing holes and the first active vibration member and connected to the first active vibration member.

According to one or more example embodiments of the present disclosure, the blowing apparatus may further comprise a connection member between each of the first and second passive vibration members and the second active vibration member. For example, there may be either one connection member crossing the second active vibration member to connect each of the first and second passive vibration members to the second active vibration member, or there may be a first connection member connecting the first passive vibration member to the second active vibration member and a second connection member connecting the second passive vibration member to the second active vibration member.

According to one or more example embodiments of the present disclosure, the first passive vibration member may comprise a first end portion adjacent to the one or more first blowing holes, and a second end portion at a first periphery portion of the first active vibration member, and the second passive vibration member may comprise a first end portion adjacent to the one or more second blowing holes, and a second end portion at a second periphery portion of the first active vibration member.

According to one or more example embodiments of the present disclosure, a corner portion of the first end portion of the first passive vibration member may have a curved shape, and a corner portion of the first end portion of the second passive vibration member may have a curved shape.

According to one or more example embodiments of the present disclosure, each of the first and second passive vibration members may comprise a plurality of regions having different hardnesses and/or including different materials.

According to one or more example embodiments of the present disclosure, in the first passive vibration member, the plurality of regions may be implemented in a radial shape with respect to a connection portion between the first active vibration member and the first passive vibration member.

According to one or more example embodiments of the present disclosure, in the second passive vibration member, the plurality of regions may be implemented in a radial shape with respect to a connection portion between the first active vibration member and the second passive vibration member.

According to one or more example embodiments of the present disclosure, a first region of the plurality of regions may comprise the second end portion and has a first hardness, a second region of the plurality of regions may comprise the first end portion and has a second hardness which is smaller than the first hardness, and a third region between the first region and the second region may comprise a corner portion of the first end portion and has a third hardness which is smaller than each of the first hardness and the second hardness.

According to one or more example embodiments of the present disclosure, the vibration apparatus may further comprise at least one of: an adhesive member between the first active vibration member and the second active vibration member, and a coupling member coupled to the inner lateral surface of the housing to support the second active vibration member.

According to one or more example embodiments of the present disclosure, the second active vibration member may comprise a 2-1$^{st}$ active vibration member and a 2-2$^{nd}$ active vibration member each connected to the first active vibration member by the adhesive member, and each of the 2-1$^{st}$ active vibration member and the 2-2$^{nd}$ active vibration member may be disposed along a direction intersecting with the first active vibration member and are spaced apart from each other in a center portion of the first active vibration member.

According to one or more example embodiments of the present disclosure, the second active vibration member may comprise two second active vibration members each connected to the first active vibration member by an adhesive member and/or each connected to one of two sidewalls of the housing opposing each other, i.e. to the (first) sidewall and to a second sidewall opposite thereto. The two second active vibration members may extend along the same line and/or perpendicular to an extension direction of the first active vibration member. The second active vibration member may comprise a 2-1$^{st}$ active vibration member (or first second active vibration member) and a 2-2$^{nd}$ active vibration member (or second active vibration member) each connected to the first active vibration member by the adhesive member. Each of the 2-1$^{st}$ active vibration member and the 2-2$^{nd}$ active vibration member may be disposed along a direction intersecting with the first active vibration member and/or may be spaced apart from each other in a center portion of the first active vibration member.

According to one or more example embodiments of the present disclosure, the vibration apparatus may further comprise a mass member between the adhesive member and the second active vibration member, and the mass member may comprise a 1-1$^{st}$ mass member between the adhesive member and a first periphery portion of the 2-1$^{st}$ active vibration member, and a 1-2$^{nd}$ mass member between the adhesive member and a first periphery portion of the 2-2$^{nd}$ active vibration member.

According to one or more example embodiments of the present disclosure, each of the 1-1$^{st}$ mass member and the 1-2$^{nd}$ mass member may comprise an elastic material having strength which is smaller than a bending strength of or at least one of each of the first active vibration member and the second active vibration member.

According to one or more example embodiments of the present disclosure, the blowing apparatus may further comprise a mass member disposed at at least one or more among a region between the first active vibration member and the second active vibration member, a rear center portion of the first active vibration member, and an upper surface of the second active vibration member overlapping a center portion of the first active vibration member.

A blowing apparatus according to one or more example embodiments of the present disclosure may comprise a housing including an accommodating space and one or more blowing holes; and a vibration apparatus in the accommodating space, wherein the vibration apparatus may comprise: a first active vibration member; a second active vibration member connected to an inner lateral surface of the housing and connected to intersect with the first active vibration member; a passive vibration member between the one or more blowing holes and the first active vibration member and connected to the first active vibration member and the second active vibration member; a balance member disposed at the first active vibration member; a connection member between the passive vibration member and the second active vibration member; an adhesive member between the first active vibration member and the second active vibration member; and a mass member between the adhesive member and the second active vibration member.

According to one or more example embodiments of the present disclosure, the passive vibration member may be disposed at a first periphery portion of the first active vibration member adjacent to the one or more blowing holes, and the balance member may be disposed at a second periphery portion parallel to the first periphery portion of the first active vibration member.

In another aspect, an apparatus may comprise a housing including an accommodating space and having at least one blowing hole, and a vibration apparatus accommodated in the accommodating space, wherein the vibration apparatus comprises a first active vibration member, a second active vibration member connected to an inner lateral surface or (first) sidewall of the housing and to the first active vibration member in order to mount or suspend the first active vibration member within the accommodating space, and a passive vibration member connected to the first active vibration member to face the blowing hole.

In another aspect, an apparatus comprises a housing including an accommodating space and one or more first and second blowing holes parallel to one another, and a vibration apparatus in the accommodating space, wherein the vibration apparatus comprises a first active vibration member, a second active vibration member connected to an inner lateral surface of the housing and connected to intersect with the first active vibration member, a first passive vibration member between the one or more first blowing holes and the first active vibration member and connected to the first active vibration member, and a second passive vibration member between the one or more second blowing holes and the first active vibration member and connected to the first active vibration member.

The apparatuses according to any one of these aspects may include one or more of the following features:

The apparatus may be denoted as an apparatus for generating wind or a blowing apparatus.

The vibration apparatus may be connected to, or suspended in, the housing by the second active vibration member (only). The second active vibration member may comprise two second active vibration members. The second active vibration member(s) may be connected to or mounted at opposite sidewalls of the housing. The second active vibration member(s) may extend through or span the accommodation space. The second active vibration member(s) may be suspended between opposite sidewalls of the housing.

The passive vibration member and/or the first active vibration member may be mounted within the accommodation space to face the blowing hole. The passive vibration member and/or the first active vibration member may be mounted within the accommodation space in the middle of two opposing sidewalls.

The blowing hole may be provided in a sidewall of the housing extending perpendicular and/or being adjacent to the sidewall to which the second active vibration member is connected.

The apparatus may further comprise a balance member disposed at the first active vibration member. The passive vibration member may be disposed at a portion of the first active vibration member opposite to a portion at which the passive vibration member is disposed. The second active vibration member may be connected to the first active vibration member at a portion between the balance member and the passive vibration member. The passive vibration member may be disposed at a first periphery portion of the first active vibration member adjacent to the one or more blowing holes, and the balance member may be disposed at a second periphery portion parallel to the first periphery portion of the first active vibration member.

The apparatus may further comprise a connection member between the passive vibration member and the second active vibration member. For example, the connection member may connect the passive vibration member and the second active vibration member. The connection member may be spaced apart from the first active vibration member.

The vibration apparatus may further comprise at least one of: an adhesive member between the first active vibration member and the second active vibration member; and a coupling member coupled to the inner lateral surface of the housing to support the second active vibration member.

The second active vibration member may comprise a 2-1$^{st}$ active vibration member and a 2-2$^{nd}$ active vibration member each connected to the first active vibration member by the adhesive member, and each of the 2-1$^{st}$ active vibration member and the 2-2$^{nd}$ active vibration member may be disposed along a direction intersecting with the first active vibration member and are spaced apart from each other in a center portion of the first active vibration member.

The vibration apparatus may further comprise a mass member between the adhesive member and the second active vibration member, and the mass member may comprise a 1-1$^{st}$ mass member between the adhesive member and a first periphery portion of the 2-1$^{st}$ active vibration member; and a 1-2$^{nd}$ mass member between the adhesive member and a first periphery portion of the 2-2nd active vibration member.

Each of the 1-1$^{st}$ mass member and the 1-2$^{nd}$ mass member may comprise an elastic material having strength which is smaller than a bending strength of each of the first active vibration member and the second active vibration member.

The passive vibration member may comprise a first end portion (or first edge) adjacent to the one or more blowing holes, and a second end portion (or second edge) at a periphery portion of the first active vibration member. That is, the passive vibration member may comprise a first end portion facing the blowing hole and a second end portion opposite to the first end portion and extending parallel to the first end portion. The passive vibration member may have a substantially rectangular shape. At least one corner portion of the first end portion may have a curved shape and/or be rounded (i.e. in a plane perpendicular to the sidewall of the housing to which the second active vibration member is mounted).

The passive vibration member may comprise a plurality of regions having different hardnesses and/or including (or being made) different materials.

The plurality of regions may be implemented in a radial shape with respect to a connection portion between the first active vibration member and the passive vibration member. That is, the plurality of regions may extend from the connection portion to an edge of the passive vibration member and/or may be arranged in circumferential direction around the connection portion. Thus, the regions may have a shape of a sector, respectively.

A first region of the plurality of regions may comprise the second end portion and may have a first hardness. A second region of the plurality of regions may comprise the first end portion and may have a second hardness which is smaller than the first hardness. A third region between the first region and the second region may comprise a corner portion of the first end portion and may have a third hardness which is smaller than each of the first hardness and the second hardness. The passive vibration member may be divided into a plurality of regions, the plurality of regions may include: a first region of which one edge is formed by the first end portion of the passive vibration member facing the blowing hole; at least one second region (e.g. two second regions) of which one edge is formed by the second end portion of the passive vibration member being opposite to the first end portion; and at least one third region (e.g. two third regions) disposed between the first and second region and of which one edge is (respectively) formed by a corner portion of the passive vibration member that faces the blowing hole. The first region may be the hardest. The third region may be the softest. That is, the first hardness may be higher than the second hardness and third hardness. The two second regions may extend from the connection portion to an outer edge of the passive vibration member and/or respectively comprise half of the second end portion of the passive vibration member. The passive vibration member and/or the plurality of regions may be symmetrical with respect to a line being perpendicular to the second end portion and crossing the connection portion.

The blowing hole may include a first blowing hole and a second blowing hole. The first blowing hole and the second blowing hole may be disposed facing each other and/or in opposite sidewalls of the housing. The blowing holes may include one or more first and second blowing holes parallel to one another. The passive vibration member may include a first passive vibration member between the one or more first blowing holes and the first active vibration member and connected to the first active vibration member, and/or a second passive vibration member between the one or more second blowing holes and the first active vibration member and connected to the first active vibration member.

The apparatus may further comprise a connection member between each of the first and second passive vibration members and the second active vibration member. There may be either one connection member crossing the second active vibration member to connect each of the first and second passive vibration members to the second active vibration member, or there may be a first connection member connecting the first passive vibration member to the second active vibration member and a second connection member connecting the second passive vibration member to the second active vibration member.

The second active vibration member may comprise two second active vibration members each connected to the first active vibration member by an adhesive member and/or each connected to one of two sidewalls of the housing opposing each other, i.e. to the (first) sidewall and to a second sidewall opposite thereto. The two second active vibration members may extend along the same line and/or perpendicular to an extension direction of the first active vibration member. The second active vibration member may comprise a 2-1$^{st}$ active vibration member (or first second active vibration member) and a 2-2$^{nd}$ active vibration member (or second active vibration member) each connected to the first active vibration member by the adhesive member. Each of the 2-1$^{st}$ active vibration member and the 2-2$^{nd}$ active vibration member may be disposed along a direction intersecting with the first active vibration member and/or may be spaced apart from each other in a center portion of the first active vibration member.

It will be apparent to those skilled in the art that various modifications and variations can be made in the blower apparatus of the present disclosure without departing from the technical idea or scope of the disclosure. Thus, it is intended that the present disclosure cover the modifications and variations of this disclosure provided they come within the scope of the appended claims and their equivalents.

What is claimed is:

1. A blowing apparatus, comprising:

a housing including an accommodating space and one or more blowing holes; and a vibration apparatus in the accommodating space, wherein the vibration apparatus comprises:

a first active vibration member;

a second active vibration member connected to an inner lateral surface of the housing and connected to intersect with the first active vibration member; and a passive vibration member between the one or more blowing holes and the first active vibration member and connected to the first active vibration member.

2. The blowing apparatus of claim 1, further comprising a balance member disposed at the first active vibration member, wherein the passive vibration member is disposed at a first periphery portion of the first active vibration member adjacent to the one or more blowing holes, and wherein the balance member is disposed at a second periphery portion parallel to the first periphery portion of the first active vibration member.

3. The blowing apparatus of claim 1, further comprising a connection member between the passive vibration member and the second active vibration member.

4. The blowing apparatus of claim 1, wherein the passive vibration member comprises:

a first end portion adjacent to the one or more blowing holes; and a second end portion at a periphery portion of the first active vibration member, and wherein a corner portion of the first end portion has a curved shape.

5. The blowing apparatus of claim 4, wherein the passive vibration member comprises a plurality of regions having different hardnesses and/or including different materials.

6. The blowing apparatus of claim 5, wherein the plurality of regions are implemented in a radial shape with respect to a connection portion between the first active vibration member and the passive vibration member.

7. The blowing apparatus of claim 6, wherein:

a first region of the plurality of regions comprises the second end portion and has a first hardness;

a second region of the plurality of regions comprises the first end portion and has a second hardness which is smaller than the first hardness; and a third region between the first region and the second region comprises the corner portion of the first end portion and has a third hardness which is smaller than each of the first hardness and the second hardness.

8. The blowing apparatus of claim 1, wherein the vibration apparatus further comprises:

an adhesive member between the first active vibration member and the second active vibration member; and a coupling member coupled to the inner lateral surface of the housing to support the second active vibration member.

9. The blowing apparatus of claim 8, wherein:

the second active vibration member comprises a 2-1$^{st}$ active vibration member and a 2-2$^{nd}$ active vibration member each connected to the first active vibration member by the adhesive member; and each of the 2-1$^{st}$ active vibration member and the 2-2$^{nd}$ active vibration member are disposed along a direction intersecting with the first active vibration member and are spaced apart from each other in a center portion of the first active vibration member.

10. The blowing apparatus of claim 9, wherein:

the vibration apparatus further comprises a mass member between the adhesive member and the second active vibration member, and the mass member comprises:

a 1-1$^{st}$ mass member between the adhesive member and a first periphery portion of the 2-1$^{st}$ active vibration member; and a 1-2$^{nd}$ mass member between the adhesive member and a first periphery portion of the 2-2$^{nd}$ active vibration member.

11. The blowing apparatus of claim 10, wherein each of the 1-1$^{st}$ mass member and the 1-2$^{nd}$ mass member comprises an elastic material having strength which is smaller than a bending strength of each of the first active vibration member and the second active vibration member.

12. The blowing apparatus of claim 1, further comprising a mass member disposed at at least one or more among a region between the first active vibration member and the second active vibration member, a rear center portion of the first active vibration member, and an upper surface of the second active vibration member overlapping a center portion of the first active vibration member.

13. A blowing apparatus, comprising:

a housing including an accommodating space and one or more first and second blowing holes parallel to one another; and a vibration apparatus in the accommodating space, wherein the vibration apparatus comprises:

a first active vibration member;

a second active vibration member connected to an inner lateral surface of the housing and connected to intersect with the first active vibration member;

a first passive vibration member between the one or more first blowing holes and the first active vibration member and connected to the first active vibration member; and a second passive vibration member between the one or more second blowing holes and the first active vibration member and connected to the first active vibration member.

14. The blowing apparatus of claim 13, further comprising a connection member connecting the first passive vibration member and the second active vibration member connecting the second passive vibration member and the second active vibration member.

15. The blowing apparatus of claim 13, wherein the first passive vibration member comprises:

a first end portion adjacent to the one or more first blowing holes; and a second end portion at a first periphery portion of the first active vibration member, and wherein the second passive vibration member comprises:

a first end portion adjacent to the one or more second blowing holes; and a second end portion at a second periphery portion of the first active vibration member.

16. The blowing apparatus of claim 15, wherein a corner portion of the first end portion of the first passive vibration member has a curved shape, and wherein a corner portion of the first end portion of the second passive vibration member has a curved shape.

17. The blowing apparatus of claim 15, wherein each of the first and second passive vibration members comprises a plurality of regions having different hardnesses or including different materials.

18. The blowing apparatus of claim 17, wherein, in the first passive vibration member, the plurality of regions are implemented in a radial shape with respect to a connection portion between the first active vibration member and the first passive vibration member.

19. The blowing apparatus of claim 18, wherein:

a first region of the plurality of regions comprises the second end portion and has a first hardness;

a second region of the plurality of regions comprises the first end portion and has a second hardness which is smaller than the first hardness; and a third region between the first region and the second region comprises a corner portion of the first end portion and has a third hardness which is smaller than each of the first hardness and the second hardness.

20. The blowing apparatus of claim 17, wherein, in the second passive vibration member, the plurality of regions are implemented in a radial shape with respect to a connection portion between the first active vibration member and the second passive vibration member.

21. The blowing apparatus of claim 13, wherein the vibration apparatus further comprises:

an adhesive member between the first active vibration member and the second active vibration member; and a coupling member coupled to the inner lateral surface of the housing to support the second active vibration member.

22. The blowing apparatus of claim 21, wherein:

the second active vibration member comprises a 2-1$^{st}$ active vibration member and a 2-2$^{nd}$ active vibration member each connected to the first active vibration member by the adhesive member; and each of the 2-1$^{st}$ active vibration member and the 2-2$^{nd}$ active vibration member are disposed along a direction intersecting with the first active vibration member and are spaced apart from each other in a center portion of the first active vibration member.

23. The blowing apparatus of claim 22, wherein:

the vibration apparatus further comprises a mass member between the adhesive member and the second active vibration member; and the mass member comprises:

a 1-1$^{st}$ mass member between the adhesive member and a first periphery portion of the 2-1$^{st}$ active vibration member; and a 1-2$^{nd}$ mass member between the adhesive member and a first periphery portion of the 2-2$^{nd}$ active vibration member.

24. The blowing apparatus of claim 23, wherein each of the 1-1$^{st}$ mass member and the 1-2$^{nd}$ mass member comprises an elastic material having strength which is smaller than a bending strength of each of the first active vibration member and the second active vibration member.

25. The blowing apparatus of claim 13, further comprising a mass member disposed at at least one or more among a region between the first active vibration member and the second active vibration member, a rear center portion of the first active vibration member, and an upper surface of the second active vibration member overlapping a center portion of the first active vibration member.

26. A blowing apparatus, comprising:

a housing including an accommodating space and one or more blowing holes; and a vibration apparatus in the accommodating space, wherein the vibration apparatus comprises:

a first active vibration member;

a second active vibration member connected to an inner lateral surface of the housing and connected to intersect with the first active vibration member;

a passive vibration member between the one or more blowing holes and the first active vibration member and connected to the first active vibration member and the second active vibration member;

a balance member disposed at the first active vibration member;

a connection member between the passive vibration member and the second active vibration member;

an adhesive member between the first active vibration member and the second active vibration member; and a mass member between the adhesive member and the second active vibration member.

27. The blowing apparatus of claim 26, wherein the passive vibration member is disposed at a first periphery portion of the first active vibration member adjacent to the one or more blowing holes, and wherein the balance member is disposed at a second periphery portion parallel to the first periphery portion of the first active vibration member.

* * * * *